US006382783B1

(12) United States Patent
Hayashi et al.

(10) Patent No.: US 6,382,783 B1
(45) Date of Patent: May 7, 2002

(54) LIQUID SUPPLY METHOD, CAPILLARY FORCE GENERATING MEMBER CONTAINER USED FOR METHOD THEREOF, AND LIQUID SUPPLY CONTAINER

(75) Inventors: Hiroki Hayashi, Kawasaki; Shozo Hattori, Tokyo; Hajime Yamamoto; Eiichiro Shimizu, both of Yokohama; Hiroshi Koshikawa; Kenji Kitabatake, both of Kawasaki, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/597,803

(22) Filed: Jun. 19, 2000

(30) Foreign Application Priority Data

Jun. 24, 1999 (JP) ..... 11-179052

(51) Int. Cl.[7] ..... B41J 2/175
(52) U.S. Cl. ..... 347/85
(58) Field of Search ..... 347/85, 86, 87, 347/49; 222/187; 239/145, 44

(56) References Cited

U.S. PATENT DOCUMENTS 5,453,771 A * 9/1995 Waseda et al. ..... 347/86
5,619,238 A 4/1997 Higuma et al. ..... 347/86
5,742,312 A * 4/1998 Carlotta ..... 347/87
6,010,212 A * 1/2000 Yamashita et al. ..... 347/86
6,012,808 A 1/2000 Koitabashi et al. ..... 347/86
6,019,459 A * 2/2000 Pew et al. ..... 347/85
6,174,053 B1 * 1/2001 Higuma et al. ..... 347/86
6,206,513 B1 * 3/2001 Tajima et al. ..... 347/86

FOREIGN PATENT DOCUMENTS

| | | |
|---|---|---|
| EP | 0 691 207 | 1/1996 |
| JP | 8-20015 | 1/1986 |
| JP | 6-226990 | 8/1994 |
| JP | 7-125232 | 5/1995 |
| JP | 8-034122 * | 2/1996 |

* cited by examiner

*Primary Examiner*—Michael Nghiem
(74) *Attorney, Agent, or Firm*—Fitzpatrick, Cella, Harper & Scinto

(57) ABSTRACT

A liquid supply method using a liquid supply system has a capillary force generating member container, an atmospheric air communication portion a liquid supply portion, a communication portion and a liquid supply container. A capillary force generating member container has a capillary force generating member, a communication portion, an atmospheric air communication portion and a liquid supply portion, and a liquid supply container that can be attached to and removed from a capillary force generating member container having a capillary force generating member an atmospheric air communication portion and a liquid supply portion.

11 Claims, 13 Drawing Sheets

LIQUID SUPPLY METHOD, CAPILLARY FORCE GENERATING MEMBER CONTAINER USED FOR METHOD THEREOF, AND LIQUID SUPPLY CONTAINER

BACKGROUND OF THE INVENTION

1. Field of the Invention

The present invention relates to an ink tank preferably used for an ink-jet recorder or the like, particularly to a liquid supply method in which a part of a container can be changed.

2. Related Background Art

A conventional ink-jet recorder uses an ink tank for storing ink by a negative pressure generated by a capillary force as an ink tank for storing a liquid (ink) to be attached to a recording medium to perform recording and supplying the ink to an ink-jet recording head for discharging the ink to the recording medium.

The most general configuration of the ink tank uses the capillary force of a porous body and includes a porous body such as sponge set or preferably compressively set in the whole ink tank to store ink and an atmospheric air communication portion capable of introducing air into an ink storage portion for smoothly supplying ink under printing.

However, the ink tank using the porous member as a capillary force generating member for storing ink has a low ink-storage efficiency for unit volume. Therefore, the present applicant proposes an ink tank comprising a capillary force generating member container for storing a capillary-force generation member and a liquid supply container for storing the ink to be supplied to the capillary force generating member container though a communication portion in Japanese Patent Application Laid-Open No. 7-125232. That is, in case of the above configuration, because the liquid supply container stores only ink, the ink storage efficiency is improved by storing ink in the container.

The liquid supply container is substantially closed except the communication portion and the capillary force generating member container is exposed to the atmospheric air through the atmospheric air communication portion. When ink is supplied from the liquid supply portion, air is introduced into the capillary-force generation member from the atmospheric air communication portion through a buffer chamber and the ink is supplied to the capillary-force generation portion from the liquid supply container while the air is introduced into the liquid supply container from the capillary-force generation member. Ink is supplied to the capillary force generating member container from the liquid supply container in accordance with gas-liquid change operation.

Moreover, the present applicant proposes an invention making it possible to change liquid containers of an ink tank having the above structure in Japanese Patent Application Laid-Open No. 6-226990. According to the invention, it is possible to repeatedly use a capillary force generating member container by consuming the ink in the liquid supply container and thereafter, changing the empty liquid supply container to a new liquid supply container filled with ink.

On the other hand, the present applicant proposes an ink tank using a fiber body made of a thermoplastic olefin-based resin (e.g. polypropylene or polyethylene) as a capillary-force generation member of the ink tank in Japanese Patent Application Laid-Open No. 8-20115. The ink tank is superior in ink storage stability and moreover superior in recycling characteristic since both the body of the ink tank and the fiber body are made of the same kind of material.

SUMMARY OF THE INVENTION

The present inventor et al. studied a liquid supply method using the above gas-liquid change system and resultantly obtained new information for flow and change of liquid and gas introduction about connection position and setting/removal between a liquid supply container and a negative pressure generating member container.

That is, the present inventor et al. completed a new liquid supply method by setting a plurality of liquid storage members (sponges or fiber bodies or the like serving as negative pressure generating members) in a negative pressure generating member container, noticing the positional relation between their contact faces of the storage members and joints of a liquid supply container with the members, and technically analyzing a configuration or system for further improving a liquid supply performance.

A liquid supply method according to the present invention is a liquid supply method according to a liquid supply system comprising a liquid supply container having a liquid storage portion for storing liquid in a closed, a capillary-force generation member which can be set to or removed from the liquid supply container and hold the liquid, an atmospheric air communication portion for communicating with atmospheric air, and a capillary force generating member container provided with a liquid supply portion for supplying liquid to the outside, which is applied to a system using at least two liquid storage members made of fiber and contacted each other as the capillary force generating member.

As a result of studying the above liquid supply system, the present inventor et al. obtained the following three aspects.

(First aspect)

It is a first aspect according to the present invention that at the time of taking a liquid supply container out of a capillary force generating member container, movement of the ink left in a communication portion to a capillary force generating member is changed due to the relation between the position of a contact face of the liquid storage member and the position of the communication portion.

In this first aspect, it is characterized that the contact face is present below the upper end of the communication portion.

(Second aspect)

It is a second aspect according to the present invention that movement of gas during gas-liquid change operation is changed due to the relation between the position of a contact face and that of a communication portion.

In this second aspect, it is characterized that the contact face is present below the upper end of the communication portion and above the lower end of the communication portion.

Even if a gas-liquid interface lowers as ink is consumed and the level of ink in a liquid supply container lowers, lowering of the gas-liquid interface is controlled by the contact face in the communication portion. Therefore, air is introduced into a liquid supply container from the upper side of the communication portion before it is introduced into a lower absorption body (liquid storage member) and thereby, the ink discharged out of the liquid supply container is directly discharged to the lower absorption body (liquid storage member).

Therefore, it is possible to sequence operations and make the operations securely function so as to first, consume the ink in the upper absorption body and the ink in the liquid supply container through gas-liquid change operation and thereafter consume the ink in the lower absorption body (liquid storage member).

(Third aspect)

It is a third aspect according to the present invention that ink movement in a capillary force generating member container when connected with a liquid supply container is changed due to the relation between the position of a contact face and that of a communication portion.

In this third aspect, it is characterized that the contact face is present below the lower end of the communication portion.

When the liquid supply container is connected to the capillary force generating member container in which ink is consumed and the ink is injected into the liquid supply container, the injected ink controls a gas-liquid interface once by a pressure-welding face because the contact face is formed at the lower side of the communication portion. Therefore, it is possible to immediately stabilize the gas-liquid interface of the injected ink.

The present invention is summarized by an invention of "locating a contact face below the upper end of a communication portion" as the synthesis of these first to third aspects.

Under the normal operating state in which a liquid supply container is connected with a capillary force generating member container, a gas-liquid interface L is formed nearby the upper end of a communication portion. Therefore, in case of a liquid supply method of the present invention, a gas-liquid interface is formed in the upper capillary force generating member in two liquid holding members contacted each other under the normal operating state. Therefore, the liquid (ink) left in the communication portion at the time of taking the liquid supply container out of the capillary force generating member container is absorbed in the capillary force generating member container as the gas-liquid interface rises in the upper capillary force generating member. Thus, the ink left in the communication portion can be smoothly absorbed because it can be avoided that a gas-liquid interface reaches the contact face between two liquid holding members due to absorption of ink and an ink absorption rate is decreased because the gas-liquid interface is not easily moved above the contact face like the case of the conventional example. Moreover, when setting the position of the contact face below the upper end of the communication portion and above the lower end of the communication portion, it is possible to prevent the gas-liquid interface from moving to the lower liquid holding member and consume the ink in the upper liquid holding member and thereafter, consume the ink in the lower liquid holding member by introducing an air into the liquid supply container. Furthermore, when connecting the liquid supply container to the capillary force generating member container in which ink is consumed and injecting ink into the container, because the contact face is formed at the lower side of the communication portion, the injected ink controls the gas-liquid interface once by the pressure welding face and thereby, it is possible to immediately stabilize the gas-liquid interface of the injected ink.

Moreover, by forming a configuration so that the contact face is present below the lower end of the communication portion, a gas-liquid interface can be more securely formed above the contact face between two capillary force generating members and the above action can be securely obtained. That is, even if ink is consumed and the gas-liquid interface lowers as the level of the ink in the liquid supply container lowers, the gas-liquid interface may not easily lower below the lower end of the communication portion as long as ink remains. Therefore, the gas-liquid interface may not easily move below the contact face between two liquid holding members.

A liquid supply method of the present invention makes it possible that the ink in an upper-side liquid holding member smoothly moves into a lower-side liquid holding member as the ink in a lower-side liquid holding member is consumed when the ink is consumed from a state in which the ink is held by two liquid holding members by using a configuration in which the dynamic resistance of the liquid in the liquid holding member upper than a contact face is smaller than the dynamic resistance of the liquid in the liquid holding member lower than the contact face and thereby, it is possible to control that a gas-liquid interface deforms and moves below the contact face between two liquid holding member.

Moreover, the above configuration makes it possible to smoothly absorb ink because the ink left in a communication portion when removing a liquid supply container from a capillary force generating member container contacts with an upper liquid holding member having a small dynamic resistance. Furthermore, by using a configuration in which the contact face between two liquid holding members is present below the lower end of a communication portion as described above, only an upper liquid holding member contacts with the opening face of the communication portion. Therefore, the ink left in the communication portion can be smoothly absorbed because the ink securely contacts with an upper liquid holding member.

Furthermore, by using a configuration in which the capillary force of a liquid holding member upper than a contact face is smaller than that of a liquid holding member lower than the contact face, ink can be effectively supplied to the lower liquid holding member from the upper liquid holding member before the ink held by the liquid member upper than the contact face is completely consumed. Therefore, it is possible to realize a configuration in which ink shortage does not easily occur.

By using a configuration in which the fiber density of a liquid holding member upper than a contact face is lower than that of a liquid holding member lower than the contact face, it is possible to realize a configuration in which a liquid holding member upper than a contact face has a smaller dynamic resistance of the ink in a member and a smaller capillary force.

Moreover, by using a fiber member in which main fiber directions are oriented to the same direction as a capillary force generating member, the ink moving in the member has a large dynamic resistance in a direction perpendicular to the fibers because the fibers interrupt movement of the ink but it has a small dynamic resistance in the direction parallel with the fibers. Therefore, by setting main fiber directions of a liquid holding member to an almost-horizontal direction in the operating attitude of the fibers, it is possible to stabilize a gas-liquid interface on a horizontal plane and prevent ink shortage from occurring because the gas-liquid interface deforms and a part of the interface reaches a liquid supply portion. By setting a layer in which directions of fibers are oriented to the same direction at least nearby the upper end of a communication portion on which a gas-liquid interface is formed under the normal operating state, it is possible to achieve the above effect.

Moreover, by bringing a liquid holding member having a capillary force larger than that of other liquid holding portion into contact with a liquid supply portion, it is possible to effectively introduce ink to the liquid supply portion and efficiently completely consume the ink.

Furthermore, by setting main fiber directions of the liquid holding member of the liquid supply portion to the direction parallel with an ink supply direction, it is possible to efficiently supply ink because the ink in the ink supply direction has a small dynamic resistance.

Furthermore, when a communication portion and a liquid supply portion are located at the same height, some of the ink moving from a communication portion up to a liquid supply portion in a capillary force generating member is introduced into the liquid supply portion after temporarily moving upward when a gas-liquid interface is raised due to an environmental change and may pass through a path longer than the path of the ink linearly moving from the communication portion up to the liquid supply portion. Thus, when there is a difference between lengths of ink paths, fluctuation occurs in components of inks supplied from the liquid supply portion after passing through paths different from each other in length. Therefore, by setting the communication portion above the liquid supply portion, the ink moving from the communication portion to the liquid supply portion passes through a comparatively long downward path and the length of an ink path is almost determined by the length of the downward path. Therefore, it is possible to control the fluctuation in lengths of ink paths and reduce the fluctuation in components of inks supplied from a liquid supply portion.

DETAILED DESCRIPTION OF THE PREFERRED EMBODIMENTS

Embodiments of the present invention will be described below by referring to the accompanying drawings.

The "hardness" of a capillary force generating member of the present invention represents the "hardness" when the capillary force generating member is stored in a capillary force generating member container, which is specified by a gradient (kgf/mm) of a repulsion to a deformation of the capillary force generating member. When there are two capillary force generating members having "hardnesses" different from each other, a capillary force generating member having a larger gradient of repulsion to a deformation is defined as a "hard capillary force generating member".

First Embodiment

<Whole configuration>

Figure 1:
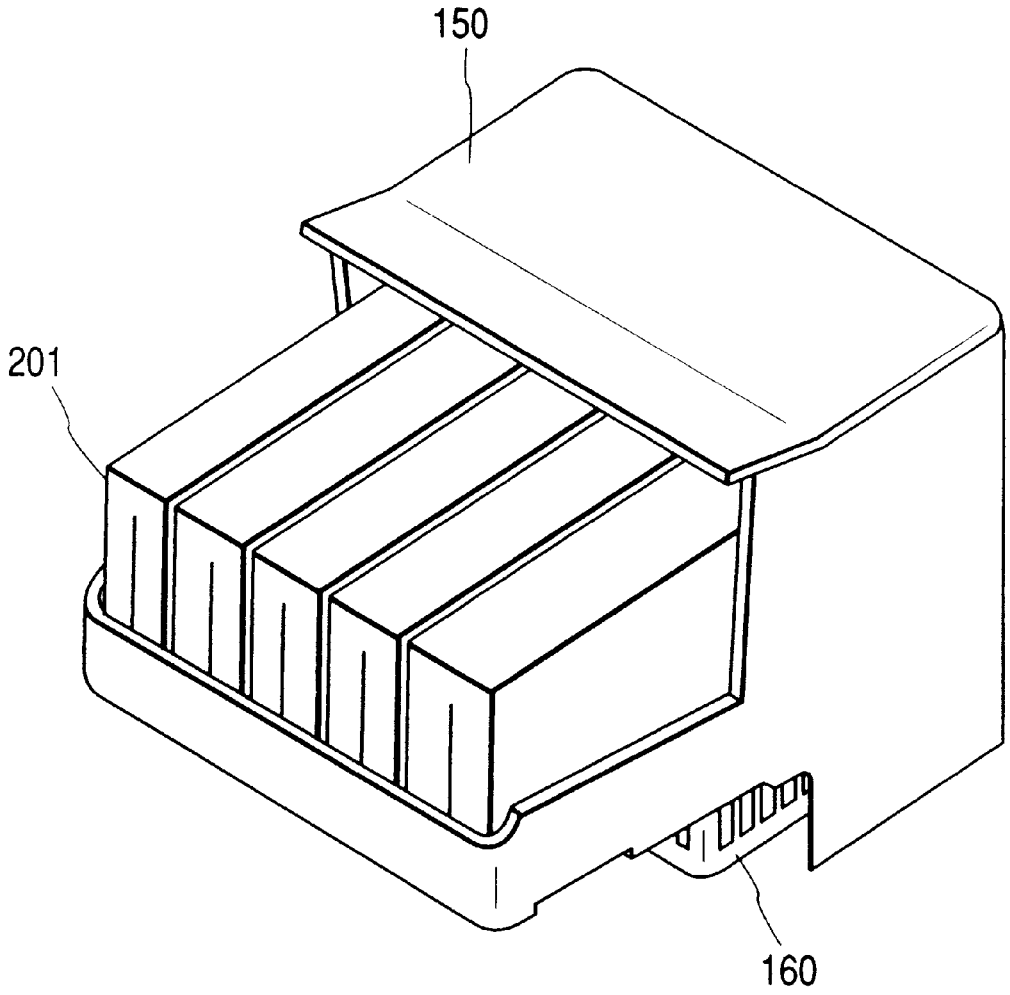
FIG. 1 is a perspective view showing an ink-jet head cartridge of a first embodiment according to the present invention.
Figure 2:
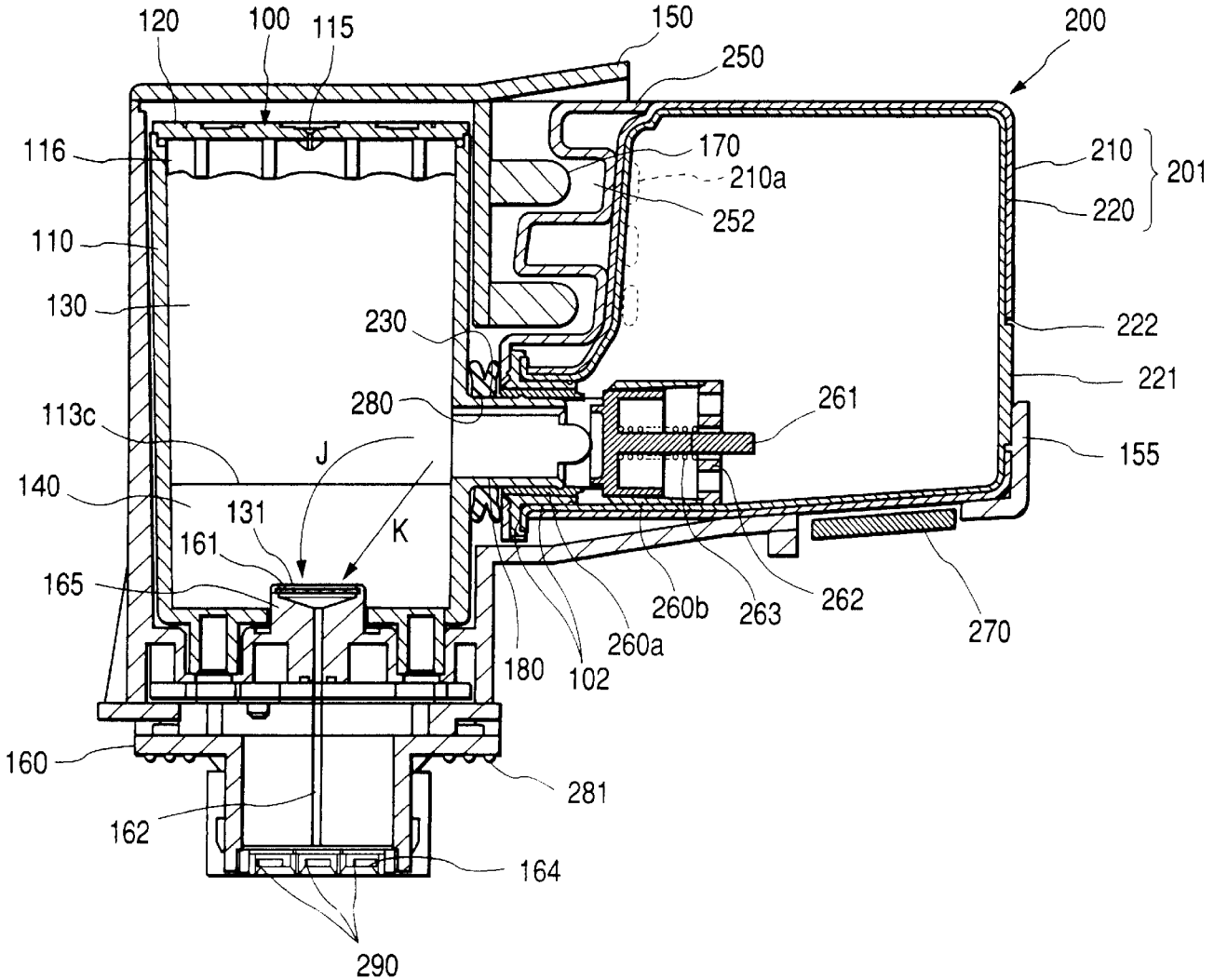
FIG. 2 is a sectional view of the cartridge in FIG. 1.

FIG. 1 shows a perspective view of an ink-jet head cartridge of an embodiment of the present invention and FIG. 2 shows a sectional view of the cartridge in FIG. 1.

In FIG. 2, it is assumed that the contact face 113*c* is provided between an upper absorption body 130 and a lower absorption body 140 and the ink level (hereafter referred to as gas-liquid interface) of the absorption bodies are L and the upper end of a joint pipe (communication portion) between a negative pressure control unit 100 and an ink-tank unit 200 which store the absorption bodies is UP and the lower end of the joint pipe is LP.

As previously described, in the case of a viewpoint how movement of gas in the gas-liquid change operation of the present invention changes to a contact face, a point how the contact face contributes to movement of gas results from the following study.

When the contact face 113*c* is formed above the lower end LP of and below the upper end UP of the joint pipe, the gas-liquid interface L moves toward an ink supply port in the upper absorption body 130 in accordance with consumption of ink. In this case, when supplying the ink at a high flow rate, fluctuation in densities of capillary force generating members in the lower absorption body 140 occurs and thereby, lowering of the gas-liquid interface L may fluctuate. However, because lowering of the gas-liquid interface L is temporarily controlled by the contact face 113*c* at the upper portion of the LP, the upper portion of the joint port communicates with air before the gas-liquid interface L moves to the lower absorption body and gas-liquid change is started. In this case, air is taken in from the upper portion of the joint port to the ink tank and discharged ink is flows to the lower absorption body 140 from the lower portion of the joint port.

Thus, the knowledge is obtained that it is possible to control the flow of ink so that the ink in the upper absorption body is consumed even when supplying the ink at a high flow rate, and gas-liquid change is started in the ink tank, and the ink in the lower absorption body is consumed after consuming the ink in the ink tank.

The following embodiment will be described by including these contents.

Then, the background of noticing ink diffusion into an absorption body when connecting an ink tank of the present invention described above will be described below.

When the contact face 113*c* is formed above the UP, the ink tank is connected, and ink is introduced into the negative pressure control chamber container from the joint port, the gas-liquid interface L of the ink entering the lower ink absorption body 140 may fluctuate.

When the contact face 113*c* is formed above the LP and below the UP, the ink tank is connected, and ink is introduced into the negative pressure control chamber container from the joint port, the gas-liquid interface L of the ink entering the lower ink absorption body 140 may fluctuate.

Moreover, because the contact face 113*c* is set in the joint port, ink is positively absorbed by the contact face. Therefore, ink may be supplied to the upper absorption body while leaving air in the lower absorption body.

When the contact face 113*c* is formed below the LP, the ink tank is connected, and ink is introduced into the negative pressure control chamber container from the joint port, the ink entering the lower absorption body 140 is positively absorbed by the contact face 113*c* present at the lower portion of the joint port. Therefore, the gas-liquid interface L in the absorption body is controlled below the joint port. Therefore, the knowledge is obtained that the ink introduced thereafter is introduced onto the gas-controlled liquid interface and thereby, it is possible to control the fluctuation of the gas-liquid interface L.

The above mentioned can be also understood by the following embodiment.

This embodiment describes elements constituting an ink-jet head cartridge to which the present invention is applied and their relations. Because this embodiment has configurations to which may new arts made when the present invention was effectuated are applied, the whole of this embodiment will be described while describing these configurations.

As shown in FIGS. 1 and 2, the ink-jet head cartridge of this embodiment is constituted of an ink-jet head unit 160, a holder 150, a negative pressure control chamber unit 100, an ink tank unit (liquid supply container) 200, or the like. The negative pressure control chamber unit 100 is fixed in the holder 150 and the ink-jet head unit 160 is fixed below the negative pressure control chamber unit 100 through a holder. In this case, the holder 150 and negative pressure control chamber unit 100 and the holder 150 and ink-jet head unit 160 are respectively fixed each other through screws or engagement so that they can be easily disassembled. This is effective for recycling, decrease in cost for a change of configurations such as changes in the version or the like, or the like. Moreover, easy disassembly is also preferable from the viewpoint that only a component to be changed can be easily changed because service lives of components are different from each other. However, it is a matter of course that it is permitted to completely fix a component through welding or thermal caulking, depending on the condition. The negative pressure control chamber unit 100 is constituted of a negative pressure control chamber container (capillary force generating member container) 110 on whose upper face an opening is formed, a negative pressure control chamber lid 120 set to the upper face of the negative pressure control chamber container 110, and two absorption bodies (capillary force generating members) 130 and 140 set in the negative pressure control chamber container 110 to impregnate and hold ink. The absorption bodies 130 and 140 are vertically superposed at two stages under the operating state of the ink-jet head cartridge and set in the negative pressure control chamber vessel 110 by being closely contacted each other. Because a capillary force generated by the lower-stage absorption body 140 is higher than a capillary force generated by the upper-stage absorption body 140, the lower-stage absorption body 140 has a higher ink-holding force. The ink in the negative pressure control chamber unit 100 is supplied to the ink-jet head unit 160 through an ink supply pipe 165.

A filter 161 is set to a supply port (liquid supply portion) 131 of the front end of the ink supply pipe 165 at the absorption body-140 side, which pushes the absorption body 140. The ink tank unit 200 is constituted so as to be removable from the holder 150. A joint pipe (communication portion) 180 serving as a joined portion provided for the face of the negative pressure control chamber container 110 at the ink tank unit-200 side is inserted into and connected with a joint port 230 of the ink tank unit 200. The negative pressure control chamber unit 100 and ink tank unit 200 are constituted so that the ink in the ink tank unit 200 is supplied into the negative pressure control chamber unit 100 through the joint between the joint pipe 180 and the joint port 230. An ID member 170 protruded from the face of the negative pressure control chamber container 110 at the ink tank unit-200 side to prevent the ink tank unit 200 from being erroneously set is provided for a portion above the joint pipe 180 on the face.

An atmospheric air communication port (atmospheric air communication portion) 115 for communicating the inside of the negative pressure control chamber container 110 with outside air, in this case, the absorption body 130 stored in the negative pressure control chamber container 110 with outside air is formed on the negative pressure control chamber lid 120 and a buffer space 116 comprising a space formed by a rib protruded from the face of the negative pressure control chamber lid 120 at the absorption body-130 side and an area in which ink (liquid) in an absorption body is absent is provided nearby the atmospheric air communication portion 115.

A valve-operating mechanism is set in the joint port 230, which is constituted of a first valve frame 260*a*, a second valve frame 260*b*, a valve element 261, an operculum 262, and an energizing member 263. The valve element 261 is slidably supported in the second valve frame 260*b* and energized to the first valve frame-260*a* side by the energizing member 263. When the joint pipe 180 is not inserted into the joint port 230, the margin of the portion of the valve element 261 at the first valve frame-260*a* side is pressed against the first valve frame 260*a* and thereby, the airtightness in the ink tank unit 200 is maintained.

When the joint pipe 180 is inserted into the joint port 230 and the valve element 261 is pressed by the joint pipe 180 and thereby moves in a direction separate from the first valve frame 260*a*, the inside of the joint pipe 180 communicates with the inside of the ink tank unit 200 through an opening formed on the side face of the second valve frame 260*b*. Thereby, the inside of the ink tank unit 200 is released and the ink in the ink tank unit 200 is supplied into the negative pressure control chamber unit 100 through the joint port 230 and joint pipe 180. That is, when a valve in the joint port 200 opens, the closed inside of the ink storage portion of the ink tank unit 200 communicates with the negative pressure control chamber unit 100 only through the opening.

It is preferable to fix the ink-jet head unit 160 and negative pressure control chamber unit 100 to the holder 150 by a method having easy disassembly such as a screw under a state in which the ink-jet head unit 160 and negative pressure control chamber unit 100 are fixed to the holder 150 as described for this embodiment because each unit can be removed and changed in accordance with its durable period.

That is, in case of the ink-jet head cartridge of this embodiment, an ink tank for storing different types of inks is not normally erroneously set to a negative pressure control chamber by an ID member provided for the ink tank. However, when an ID member provided for the negative pressure control chamber unit 100 is damaged or a user intentionally sets different types of ink tanks to the negative pressure control chamber unit 100, it is only necessary to change only the negative pressure control chamber unit 100 immediately after the ink tanks are set to the unit 100. Moreover, when the holder 150 is damaged due to a drop, it is also possible to change only the holder 150.

When separating the negative pressure control chamber unit 100, holder 150, and ink-jet head unit 160 including the ink tank unit 200 from each other, it is preferable to determine the position of a fixed portion so that it is possible to prevent ink from leaking from each unit.

In the case of this embodiment, the ink tank unit 200 combines with the negative pressure control chamber unit 100 by using an ink-tank-securing portion 155 of the holder 150. Therefore, only the negative pressure control chamber unit 100 is removed from other fixed unit. That is, unless the ink tank unit 200 is at least removed from the holder 150, the negative pressure control unit 100 is not easily removed from the holder 150. Thus, because the negative pressure control unit 100 is constituted so as not to be easily removed before the ink tank unit 200 is removed from the holder 150, leak of ink from a joint due to the fact that the ink tank unit 200 is carelessly separated from the negative pressure control chamber unit 100 does not occur.

Moreover, because the filter 161 is set to an end of the ink supply pipe 165 of the ink-jet head unit 160, ink does not leak from the ink-jet head unit 160 even when the negative pressure control chamber unit 100 is separated. Moreover, the negative pressure control chamber unit 100 is provided with the buffer space 116 (including an area not holding the ink in the absorption bodies 130 and 140) for preventing ink from leaking from the ink tank and the contact face 113*c* is formed between two absorption bodies 130 and 140 having capillary forces different from each other (more preferably, a capillary force of a layer nearby the contact face 113*c* including the face 113*c* is higher than those of areas of the absorption bodies 130 and 140). Therefore, the contact face 113*c* prevents back flow of ink from the absorption body 140 to the absorption body 130 and thereby, ink hardly leaks from a structure formed by uniting the holder 150, negative pressure control chamber unit 100, and ink tank unit 200 into one body even if attitudes of the structure are changed. Therefore, in case of this embodiment, because the ink-jet head unit 160 has a fixed portion on its bottom face serving as a side face of the holder 150 having a connection terminal, it can be easily separated even while the ink tank unit 200 is set to the holder 150.

Moreover, it is permitted that the negative pressure control chamber unit 100 or ink-jet head unit 160 and the holder 150 are united into one body so that they cannot be separated from each other. To unit them into one body, it is permitted to use a method for previously uniting them into one body or thermal caulking so that they cannot be separated from each other.

Figure 3B:
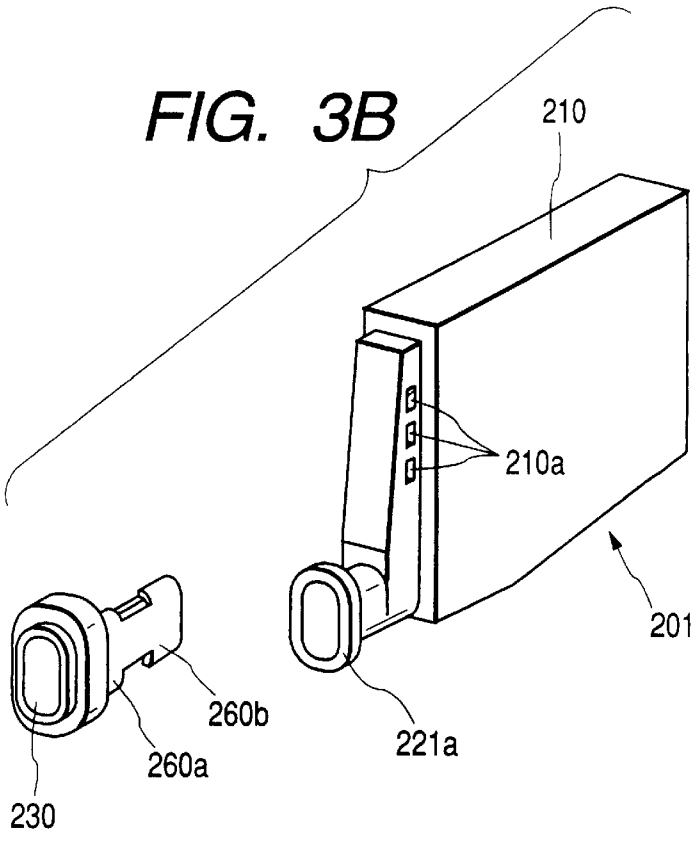
FIGS. 3A and 3B are perspective views for explaining an ink tank unit shown in FIG. 2.
Figure 3A:
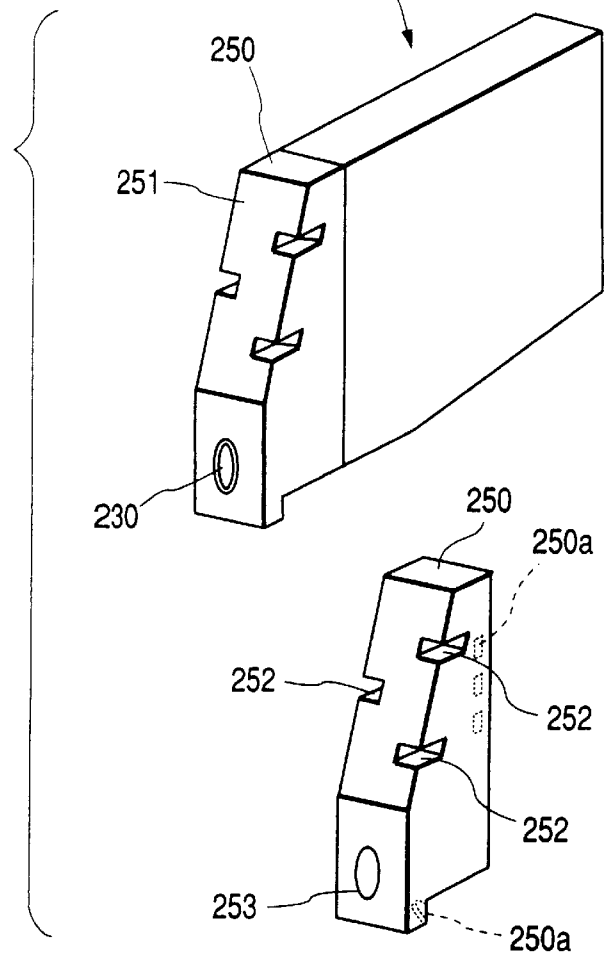

As shown in FIG. 2 and FIGS. 3A and 3B, the ink tank unit 200 is constituted of an ink container 201, a valve-operating mechanism including the first valve frame 260*a* and the second valve frame 260*b*, and an ID member 250. The ID member 250 prevents the ink tank unit 200 and negative pressure control chamber unit 100 from being erroneously set.

The valve-operating mechanism controls the flow of ink in the joint port 230, which performs opening and closing operations by being engaged with the joint pipe 180 of the negative pressure control chamber unit 100. Twisting of a valve when set or removed is prevented by a valve configuration or a structure for controlling a tank operation range by the ID member 170 and a concave portion 252 for ID to be described later.

<Ink tank unit>

FIGS. 3A and 3B are perspective views for explaining the ink tank unit 200 shown in FIG. 2. FIG. 3A is a perspective view showing the ink tank unit 200 and FIG. 3B is a perspective view showing a state in which the ink tank unit 200 is disassembled.

Moreover, at the front of the ID member 250 serving as the negative pressure control chamber unit-100 side, a portion above a supply port hole 253 serves as a slope 251. The slope 251 tilts toward the ink storage 201, that is, backward from the front-end face at the supply port hole 253-side of the ID member 250. A plurality of concave portions 252 (three concave portions in FIG. 3A) for ID for preventing the ink tank unit 200 from being erroneously inserted are formed on the slope 251. In case of this embodiment, the ID member 250 is set to the front (face having a supply port) of the ink container 201 serving as the negative pressure control chamber unit-100 side.

The ink container 201 is an almost-polygonal-prismatic hollow container having a negative pressure generation function. The ink container 201 is constituted of a housing 210 and an inner bag (liquid storage portion) 220 (refer to FIG. 2), in which the housing 210 can be separated from the inner bag 220. The inner bag 220 is flexible and can be deformed as the stored ink is discharged. Moreover, the inner bag 220 has a pinch-off portion (welding portion) 221 which supports the bag 220 so as to engage with the housing 210. Furthermore, an outside-air communication port 222 is formed on a portion nearby the pinch-off portion 221 of the housing 210 so that atmospheric air can be introduced between the inner bag 220 and the housing 210 through the outside-air communication port 222.

The inner bag 220 comprises three layers such as a liquid contact layer having an ink resistance, an elasticity control layer, and gas barrier layer superior in gas barrier property which are superposed from the inside in the order mentioned, and the layers are functionally separated from each other while connected. The elasticity of the elasticity control layer is kept almost constant in an ink-storage-container operating temperature range. That is, the elasticity of the inner bag is kept almost constant by the elasticity control layer in the ink-storage-container operating temperature range. In case of the inner bag, it is permitted that an intermediate layer is replaced with an outside layer, that is, the elasticity control layer serves as an outermost layer and the gas barrier layer serves as an intermediate layer.

Because the inner bag is constituted as described above, the inner bag can completely exhibit functions of the ink-resistant layer, elasticity control layer, and gas barrier layer and the influence of the elasticity of the inner bag on a temperature change decreases. Moreover, because an elasticity suitable to control a negative pressure in the ink container in an operating temperature range is secured in the inner bag, the inner bag has a buffer function to be described later for the ink in the ink container and negative pressure control chamber unit. (Details will be described later.) Therefore, because it is possible to decrease a buffer chamber formed at the upper portion in the negative pressure control chamber container, that is, a portion not filled with ink absorption bodies and an area in which the ink in the absorption bodies 130 and 140 is not present, it is possible to downsize the negative pressure control chamber unit 100 and thereby, realize an ink-jet head cartridge 70 having a high use efficiency.

In case of this embodiment, polypropylene is used as a material of an innermost liquid contact layer constituting the inner bag 220, cyclic-olefin copolymer is used as a material of the intermediate elasticity control layer, and (EVOH saponified EVA (ethylene-vinyl-acetate copolymer resin)) is used as a material of the outermost gas barrier layer. In this case, impregnating the elasticity control layer with a functional adhesive resin is preferable because it is unnecessary to particularly form an adhesive layer between the layers and thereby, it is possible to decrease the thickness of the inner bag 220.

The material of the housing 210 uses polypropylene that is also used for the innermost layer of the inner bag 220. Moreover, the material of the first valve frame 260*a* uses polypropylene.

The ID member 250 has a plurality of concave portions 252 for ID provided for right and left to correspond to a plurality of ID members 170 for preventing the ink tank unit 200 from being erroneously set and is fixed to the ink container 201.

An erroneous-setting preventive function obtained by the ID members 170 and the concave portions 252 for ID corresponds to a plurality of ID members 170 provided for the negative pressure control chamber unit-100 side and the concave portions 252 for ID are formed on the ID member 250, and thereby an erroneous-setting preventive mechanism is constituted. Therefore, various ID functions can be executed by changing shapes or positions of the ID member 170 and concave portion 252 for ID.

The concave portion 252 for ID of the ID member 250 and the joint port 230 of the first valve frame 260*a* are located at the front in the setting/removing direction of the ink tank unit 200 and formed on the ID member 250 and first valve frame 260*a*.

Moreover, it is possible to accurately mold a valve member and the concave portion 252 for ID by forming the ink container 201 through blow molding and the ID member 250 and first valve frame 260*a* through injection molding and constituting the ink tank unit 200 of three members.

When directly forming the concave portion 252 for ID on the ink container 201 serving as a blow tank formed through blow molding, this may influence separation of the inner bag 220 from an inner layer of the ink container 201, that is, may influence a negative pressure generated in the ink tank unit 200. However, by using a member different from the ink container 201 for the ID member 250 serving as an ID portion as shown for the configuration of the ink tank unit 200 of this embodiment, the above influence caused by setting the ID member 250 to the ink container 201 is not applied to the ink container 201. Therefore, it is possible to stably generate and control a negative pressure in the ink container 201.

The first valve frame 260*a* is connected to each of the housing 210 and inner bag 220 of the ink container 201. The first valve frame 260*a* is connected to the inner bag 220 by welding an inner-bag exposure portion 221*a* serving as an ink discharge portion of the ink container 201 with a face to which a portion of the joint port 230 corresponds. In this case, because the housing 210 is made of polypropylene same as the innermost layer of the inner bag 220, it is possible to weld the first valve frame 260*a* with the housing 210 even around the joint port 230.

Thereby, a positional accuracy by welding is improved, the supply port of the ink container 201 is completely sealed, and ink is prevented from leaking from the sealed portion between the first valve frame 260*a* and the ink container 201 when setting or removing the ink tank unit 200. To perform connection through welding like the case of the ink tank unit 200 of this embodiment, it is preferable that the material of a layer serving as a bonding face of the inner bag 220 is the same as that of the first valve frame 260*a* in order to improve the sealing performance.

Moreover, in case of connection between the housing 210 and the ID member 250, a face of the first valve frame 260*a* facing a sealed face 102 connected with the ink container 201, a click portion 250*a* formed at the lower portion of the ID member 250, an engagement portion 210*a* at the side face of the housing 210, and a click portion 250*a* at the ID member-250 side corresponding to the portion 210*a* are engaged each other and thereby, the ID member is engagement-fixed to the ink container 201.

For the above engagement-fixing, it is preferable to form a structure having easy disassembly according to engagement or fitting by irregularity. Thus, by engagement-fixing the ID member 250 to the ink container 201, they are slightly movable. Thereby, it is possible to absorb a force due to the contact between the ID member 170 and the concave portion 252 for ID at the time of setting/removing and prevent the ink tank unit 200 and negative pressure control chamber unit 100 from damaging.

Moreover, by making the ID member 250 locally engage with the ink container 201 so as to be almost fixed, the ink tank unit 200 can be easily disassembled and there is an advantage from the viewpoint of recycling. Thus, by forming a concave portion serving as the engagement portion 210*a* on the side face of the housing 210, the configuration of the ink container 201 is simplified when forming the container 201 through blow molding, a mold member for molding is also simplified, and control of a film thickness is simplified.

Moreover, the housing 210 is connected with the ID member 250 while connecting the first valve frame 260*a* to the housing 210 and the click portion 250*a* is engaged with the engagement portion 210*a* while holding the first valve frame 260*a* around the joint port 230. Therefore, it is possible to improve the strength of the ink tank unit 200, particularly the joint portion of the unit 200 when setting or removing the unit 200.

Furthermore, in the case of the ink container 201, the portion covered with the ID member 250 is concave and the supply port is protruded. Therefore, by fixing the ID member 250 to the ink container 201, it is possible to eliminate the protrusion at the front of the ink tank unit 200. Moreover, it is permitted that the concavo-convex relation between the engagement portion 210*a* of the housing 210 and the click portion 250*a* of the ID member 250 corresponding to the portion 210*a* is reverse.

Furthermore, it is possible to control positions of the ink container 201 and the ID member 250 in longitudinal and transverse directions. A method for connecting the ink container 201 with the ID member 250 is not restricted to the above mentioned. An engagement-position fixing method can use other means.

As shown in FIG. 2, the bottom of the ink container 201 tilts in a direction in which the bottom can be raised and the bottom of a portion of the ink container 201 opposite to the joint port 230-side engages with the ink-tank securing portion 155 of the holder 150. When removing the ink tank unit 200 from the holder 150, the engagement portion with the ink-tank securing portion 155 of the ink container 201 is raised. Therefore, the ink tank unit 200 almost rotates when setting or removing the unit 200. In case of this embodiment, the rotation center is located almost at the supply port (joint port 230). Strictly saying, however, the rotation center changes. When setting or removing the ink tank unit 200 almost through the rotation, a twist more frequently occurs between the ink tank unit 200 and the ink-tank securing portion 155 as the distance from the fulcrum of rotation up to a corner of the ink-tank securing portion 155 of the ink tank unit 200 becomes longer than the distance from the fulcrum up to the ink-tank securing portion 155 and a trouble may occur that an unnecessary force is generated in setting or a pressed portion of the ink tank unit 200 or holder 150 is deformed.

Because the bottom of the ink container 201 of this embodiment is tilted and the lower end of the portion serving as the ink-tank securing portion-155 side of the ink container 201 is raised, it is possible to prevent an excessive twist due to rotation of the ink tank unit 200 at engagement portions of the ink tank unit 200 and holder 150 and thereby, smoothly set or remove the ink tank unit 200.

In case of the ink-jet head cartridge of this embodiment, the joint port 230 is formed at the lower portion of one side face of the ink container 201 serving as a face of the negative pressure control chamber unit-100 side and a lower portion of other side face of the ink container 201 serving as a face opposite to the joint port-230 side, that is, a lower-side portion of the rear end engages with the ink-tank securing portion 155. Moreover, the upper portion of the ink-tank securing portion 155 extends upward from the bottom of the holder 150 up to a height almost equal to the center height 603 of the joint port 230. Thereby, horizontal movement of the joint port 230 is securely controlled by the ink-tank securing portion 155 and it is possible to preferably keep the connection state between the joint port 230 and the joint pipe 180. In this case, to securely keep the connection between the joint port 230 and the joint pipe 180 when the ink tank unit 200 is set, the upper end of the ink-tank securing portion 155 is set to a height almost equal to the upper portion of the joint port 230. Moreover, the ink tank unit 200 is removably set to the holder 150 due to the rotation of the unit 200 about a part of the front of the unit 200 at the joint port-230 side. When setting or removing the ink tank unit 200, a portion of the unit 200 contacting the negative pressure control chamber unit 100 serves as the rotation center of the ink tank unit 200. Thus, because the bottom of the rear end of the ink container 201 tilts as described above, it is possible to decrease the difference between the distance from a rotation center 600 up to an upper end 601 of the ink-tank securing portion and the distance from the rotation center 600 up to a lower end 602 of the ink-tank securing portion. Therefore, it is possible to prevent an excessive twist due to rotation of the ink tank unit 200 at engagement portions of the ink tank unit 200 and holder 150 and smoothly set or remove the ink tank unit 200.

Because the ink container 201 and holder 150 are formed into the above shapes, it is possible to decrease a twist area between the lower portion of the rear end of the ink container 201 and the ink-tank securing portion 155 when setting or removing the ink tank unit 200 also when increasing the size of the joint port 230 in order to supply ink at a high flow rate. Thereby, it is possible to avoid an unnecessary twist with the ink-tank securing portion 155 while securing the fixing property when setting the ink tank unit 200 to the holder 150.

In this case, if the distance from the rotation center 600 in setting or removing the ink tank unit 200 up to the lower end 602 of the ink-tank securing portion of the ink tank unit 200 excessively increases compared to the distance from the rotation center 600 up to the upper end 601 of the ink-tank securing portion, a force necessary for the setting or removing operation greatly increases and thereby, the upper end 601 of the ink-tank securing portion may be shaved or the ink container 201 may be deformed. Therefore, it is preferable that the difference between the distance from the rotation center 600 of the ink tank unit 200 up to the lower end 602 of the ink-tank securing portion of the ink tank unit 200 and the distance from the rotation center 600 up to the upper end 601 of the ink-tank securing portion is as small as possible in a range superior in setting/removing performance while exhibiting a proper fixing force.

Moreover, when the rotation center 600 of the ink tank unit 200 is present at a position lower than the center of the joint port 230, the distance from the rotation center 600 of the ink tank unit 200 up to the upper end 601 of the ink-tank securing portion becomes longer than the distance from the rotation center 600 up to the lower end 602 of the ink-tank securing portion and thereby, it is difficult to accurately control the ink container 201 at the height of the center of joint port 230. Therefore, to accurately fix the height-directional center of the joint port 230, it is preferable that the rotation center 600 of the ink tank unit 200 is present at a position upper than the height-directional center of the joint port 230.

Moreover, when raising the rotation center 600 of the ink tank unit 200 up to a position higher than the center height 603 of the joint port 230, the thickness of a portion of the ink tank unit 200 contacting the ink-tank securing portion 155 increases and a portion contacting the ink-tank securing portion 155 increases and thereby, the ink tank unit 200 and holder 150 may be easily damaged. Therefore, it is preferable that the rotation center 600 of the ink tank unit 200 is closer to the height-directional center of the joint port 230 from the viewpoint of the setting/removing performance of the ink tank unit 200. Moreover, it is permitted to properly determine the height of the ink-tank securing portion 155 of the ink tank unit 200 in accordance with the setting/removing performance of the ink tank unit 200. However, when setting the portion 155 to a position higher than the rotation center 600, the contact distance between the securing portions of the ink tank unit 200 and holder 150 increases and the number of portions rubbed due to setting/removing operation increases. Therefore, when considering deterioration of the ink tank unit 200 and holder 150, it is preferable that the portion 155 is lower than the rotation center 600 of the ink tank unit 200.

Moreover, in case of the ink-jet head cartridge of this embodiment, an energizing force for fixing a horizontal position of the ink container 201 is obtained from a force by the energizing member 263 for energizing the valve element 216 and a repulsion of a rubber joint portion 280 (refer to FIGS. 4A to 4D). Instead of the above mentioned, however, it is also permitted to set a securing portion to the rear end of the ink container 201, or to set energizing means for fixing a horizontal-directional position of the ink container 201 to the face of the ink-tank securing portion 155 at the ink container-201 side or to the negative pressure control chamber unit 100, or the like. The rubber joint portion 280 is press-fitted by wall surfaces of a negative pressure control chamber and an ink tank while an ink container is connected to secure the airtightness (it is enough to decrease the number of areas exposed to the atmospheric air even if complete airtightness cannot be kept) of a combined portion (periphery of joint pipe) and moreover functions as an auxiliary of a seal by a sealing protrusion to be described later.

Then, the internal configuration of the negative pressure control chamber unit 100 will be described below.

A member in which the absorption body 130 is superposed on the absorption body 140 to generate a negative pressure is stored in the negative pressure control chamber unit 100. Therefore, the absorption body 130 communicates with the atmospheric air communication portion 115 and the absorption body 140 closely contacts with the absorption body 130 at its upper side and closely contacts with the filter 161 at its lower side. The contact face 113*c* between the absorption bodies 130 and 140 is lower than the lower end of the joint pipe 180 serving as a communication portion under the operating attitude.

The absorption bodies 130 and 140 are made of fiber bodies in which fibers are almost oriented in the same direction and the main fiber direction tilts from the vertical direction (more preferably, so that the direction becomes almost horizontal like the case of this embodiment) while the ink-jet head cartridge 70 is mounted on a printer and stored in the negative pressure control chamber container 110.

The absorption bodies 130 and 140 in which fibers are oriented in the same direction are manufactured by using short fibers (having a length of approx. 60 mm and comprising mixed fibers of polypropylene and polyethylene) made of thermoplastic resin crimped as fibers and arranging directions of short fibers in a fiber group with a carding machine, then heating the fibers (it is preferable to set the heating temperature to a value higher than the melting point of polyethylene having a relatively-low melting point and lower than the melting point of polypropylene having a relatively-high melting point), and cutting the fibers into a desired length. In case of the fiber member of this embodiment, directions of fibers of the surface layer are arranged compared to those of fibers of the middle portion and a capillary force to be generated is larger than that of the middle portion. However, the surface of the fiber member is not a mirror surface but it has a slight irregularity mainly generated when bundling slivers and three-dimensionally has welded intersections even at the surface layer. Therefore, in the case of the contact face 113*c* between the absorption bodies 130 and 140 in which fiber directions are arranged, surfaces having irregularity contact each other and thereby, ink has a proper flowability in the horizontal direction as a whole together with surface areas of the absorption bodies 130 and 140 nearby the contact face 113*c*. That is, only the contact face 113*c* is particularly superior in ink flowability compared to surrounding areas and thereby, an ink path is not formed between the gap between the negative pressure control chamber container 110 and absorption bodies 130 and 140 and the contact face 113*c*. Therefore, by forming the contact face 113*c* between the absorption bodies 130 and 140, it is prevented that a part of the interface between ink and gas (gas-liquid interface) moves below the contact face 113*c* in the absorption bodies 130 and 140 and it is possible to stabilize the gas-liquid interface. Thus, it is possible to stabilize a static negative pressure at a head portion currently supplying ink.

Figure 7:
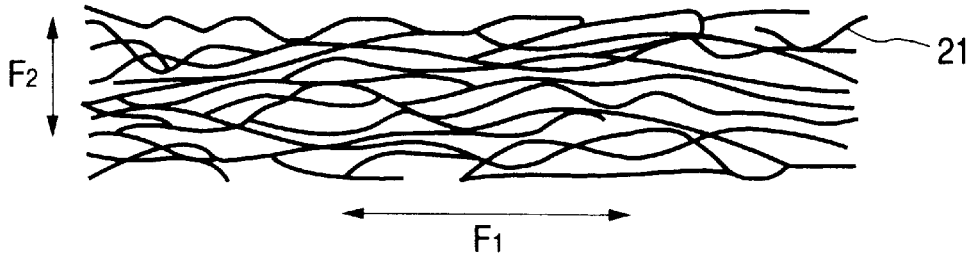
FIG. 7 is an illustration for explaining an absorption body in a negative pressure control chamber container shown in FIG. 2.

Moreover, as shown in FIG. 7, when noticing the directional property of a fiber member, fibers are continuously arrayed mainly in a longitudinal direction F1 arranged by a carding machine and the fiber member has a structure in which fibers are connected each other because some of intersections between the fibers are welded due to thermal molding in a direction F2 perpendicular to the direction F1. Therefore, the absorption bodies 130 and 140 are not easily broken even if applying a tension in the direction F1 in FIG. 7. However, when pulling the bodies 130 and 140 in the direction F2 in FIG. 7, joints between fibers are broken and the fibers can be easily separated from each other compared to the case of the direction F1.

Because the main fiber direction F1 is present in the absorption bodies 130 and 140 made of fibers, the main fiber direction F1 and the fiber direction F2 perpendicular to the direction F1 are different from each other in ink flowability and holding way under a stationary state.

Figure 8A:
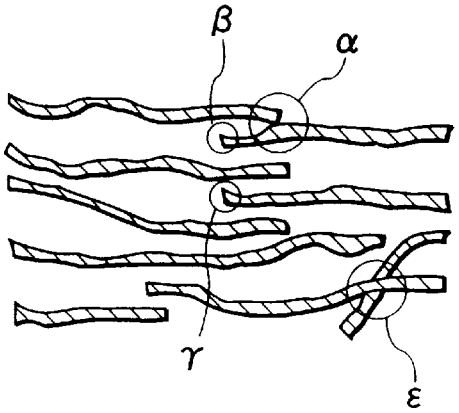
FIGS. 8A and 8B are illustrations for explaining an absorption body in the negative pressure control chamber container shown in FIG. 2.
Figure 8B:
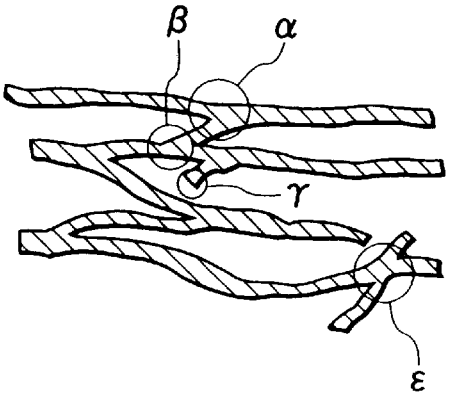

Internal structures of the absorption bodies 130 and 140 will be more minutely described below. Crimped short fibers shown in FIG. 8A are heated when some fiber directions are arranged and thereby, result in the state shown in FIG. 8B. In this case, an area (in which a plurality of short fibers are overlapped in fiber directions in FIG. 8A has a high probability in which intersections are welded as shown in FIG. 8B and resultantly, continuous fibers not easily cut in the direction F1 shown in FIG. 7 are formed in fiber directions. Moreover, by using crimped sort fibers, end areas of short fibers ($\beta$ and $\gamma$ shown in FIG. 8A) are three-dimensionally welded with other short fiber ($\beta$) or directly remain as an end ($\gamma$). Moreover, because not all fibers are arranged in the completely same direction, the short fiber ($\epsilon$ shown in FIG. 8A) tilting and contacting from the beginning with another short fiber so as to intersect with it is directly welded after heated ($\epsilon$ shown in FIG. 8B). Thus, fibers having a high strength compared to that of a conventional unidirectional fiber bundle are also formed in the direction F2.

Figure 6:
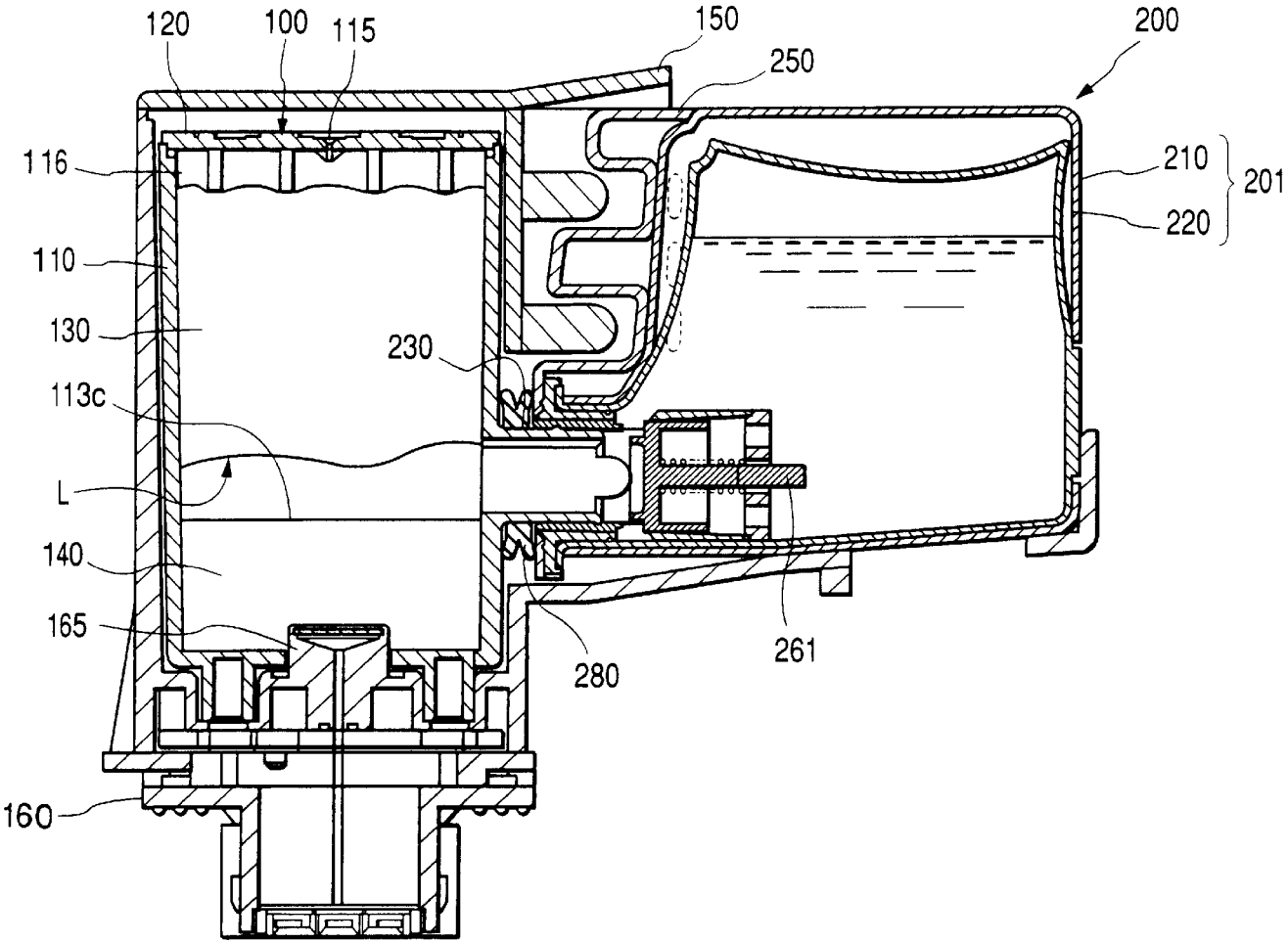
FIG. 6 is a sectional view for explaining an ink supply operation by the ink-jet head cartridge shown in FIG. 2.

Moreover, in case of this embodiment, the absorption bodies 130 and 140 are arranged so that the fiber direction F1 becomes almost horizontal and almost parallel with the direction toward an ink supply port from a communication portion. Therefore, as shown in FIG. 6, the gas-liquid interface L (interface between ink and gas) in the absorption body 140 has an almost horizontal direction parallel with the main fiber direction F1 while the ink container 201 is connected. Therefore, even if fluctuation due to an environmental change occurs, the gas-liquid interface maintains an almost horizontal direction. Therefore, when environmental fluctuation ends, the gas-liquid interface returns to the original position of the gas-liquid interface L but the fluctuation to the gravitational direction of the gas-liquid interface does not increase correspondingly to the number of cycles of environmental changes.

As a result, when the ink in the ink container 201 is completely consumed to change the ink tank unit to the new ink tank unit 200, the gas-liquid interface is kept almost horizontal. Therefore, even if the change frequency of the ink tank unit 200 increases, the buffer space 116 does not decrease.

Thus, to stabilize the position of the gas-liquid interface L under gas-liquid change independently of an environmental change, it is preferable to form a layer having a main fiber array component in almost horizontal direction in an area of the upper end of a communication portion (joint pipe 180 in the case of this embodiment) serving as a joint, more preferably in an area including a portion upper than the upper end. From another viewpoint, it is preferable that the layer is present in an area connecting the supply port 131 with the upper end of the communication portion. From still another viewpoint, it is preferable that the area is present on gas-liquid interface under gas-liquid change operation. When functionally capturing the latter, a fiber layer having the directional property of the above array makes the gas-liquid interface in the absorption body 140 horizontal under the liquid supply operation due to gas-liquid change and has a function for controlling a vertical-directional change of the absorption body 140 due to movement of liquid from the ink container 201.

By forming the above layer in the absorption body 140, the gas-liquid interface L can control the fluctuation to the gravitational direction. In this case, it is preferable that the main fiber array component is also almost parallel in the longitudinal direction at a horizontal-directional cross section of the absorption body 140 because the longitudinal direction of fibers can be effectively used.

In this case, if the fiber array direction even slightly tilts from the vertical direction, the above effect is theoretically obtained. However, when the fiber array direction is practically kept in a range of ±30° from the horizontal direction, a clear effect can be confirmed. Therefore, the term "almost" of almost horizontal includes the above tilt in this specification.

In the case of this embodiment, the main fiber direction array component is similarly constituted also in an area lower than the upper end of the communication portion because the component is constituted of the same absorption body 140. Therefore, in the case of the gas-liquid change operation shown in FIG. 6, the gas-liquid interface L does not carelessly fluctuate in an area lower than the upper end of the communication portion. Therefore, an ink supply trouble such as ink shortage does not occur.

That is, in the gas-liquid change operation, when the atmospheric air introduced through the atmospheric air communication port 115 reaches the gas-liquid interface L, it is dispersed along the main fiber direction. As a result, an interface under the gas-liquid change operation is kept almost horizontal and can be stabilized. Thus, an advantage can be obtained that it is possible to more securely supply ink while keeping a stable negative pressure. Moreover, the main fiber direction is almost horizontal also for the gas-liquid change operation in the case of this embodiment. Therefore, ink is almost uniformly consumed in the horizontal direction. As a result, it is possible to apply an ink supply method for decreasing residual ink also to the ink in the negative pressure control chamber container 110. Therefore, in the case of a system in which the ink tank unit 200 for directly storing a liquid can be changed as described for this embodiment, it is possible to effectively form an area not storing the ink in the absorption bodies 130 and 140. Therefore, the buffer space efficiency is improved and it is possible to provide an ink supply method strong in environmental fluctuation.

Moreover, when the ink-jet head cartridge of this embodiment uses a cartridge to be mounted on the so-called serial-type printer, it is set to a carriage to be reciprocally scanned. In this case, a force of a carriage-moving-directional component works on the ink in the ink-jet head cartridge in accordance with the reciprocal motion of the carriage. To minimize bad influences of the above force on ink supply characteristics from the ink tank unit 200 to the ink-jet head unit 160, it is preferable that the fiber direction of the absorption bodies 130 and 140 and the array direction of the ink tank unit 200 and negative pressure control chamber unit 100 are set to a direction toward the supply port 131 of the negative pressure control chamber container 110 from the joint port 230 of the ink tank unit 200.

<Tank setting operations>

Then, operations for setting the ink tank unit 200 to a united body of the negative pressure control chamber unit 100 and holder 150 will be described below by referring to FIGS. 4A to 4D.

FIGS. 4A to 4D are sectional views for explaining operations for setting the ink tank unit 200 to the holder 150 to which the negative pressure control chamber unit 100 is set. The ink tank unit 200 is set by almost rotating it in directions of the arrows F and G along its width-directional guide (not illustrated), the bottom 151 of the holder 150, and a guide portion 121 provided for the negative pressure control chamber lid 120 of the negative pressure control chamber unit 100, and the ink-tank securing portion 155 at the rear of the holder 150.

Figure 4A:
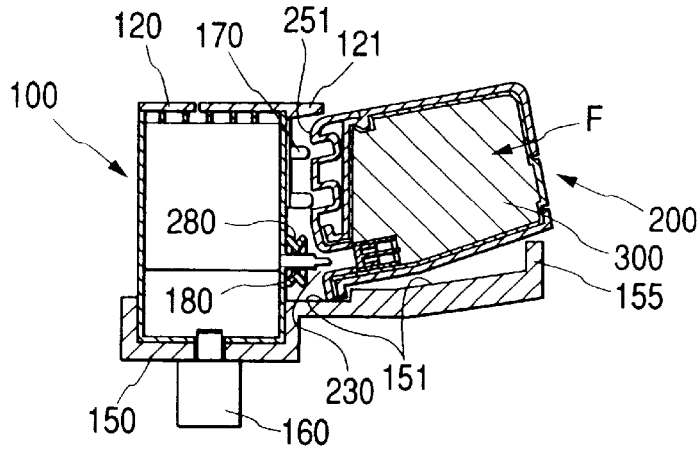
FIGS. 4A, 4B, 4C and 4D are sectional views for explaining operations for setting the ink tank unit to a holder provided with a negative pressure control chamber unit in FIG. 2.

First, as the operation for setting the ink tank unit 200, the ink tank unit 200 is moved up to the position shown in FIG. 4A, that is, the position where the slope 251 of the ink tank unit 200 contacts the ID member 170 for preventing the ink tank unit provided for the negative pressure control chamber unit 100 from being erroneously inserted. At this point of time, the joint port 230 does not contact with the join pipe 180. However, if an erroneous ink tank unit 200 is set at the above point of time, the slope 251 interferes with the ID member 170 and the subsequent operations for setting the ink tank unit 200 are prevented. Because the ink-jet head cartridge 70 is constituted as described above, the joint port 230 does to contact with the joint pipe 180 as described above. Therefore, it is possible to prevent unnecessary change of heads or ink tanks of an ink-tank-change-type apparatus due to mixing of inks at a joint portion at the time of erroneous setting, fixing of ink (a case is also considered in which fixing is caused by the absorption bodies 130 and 140 depending on an ink component (e.g. reaction of anions and cations), so that the negative pressure control chamber unit 100 cannot be used), or the like. Moreover, by the ID portion of the ID member 250 on a slope as described above and thereby almost simultaneously inserting a plurality of ID members 170 into their corresponding concave portions for ID, it is possible to confirm IDs and achieve a secure erroneous-setting-preventive function.

Figure 4B:
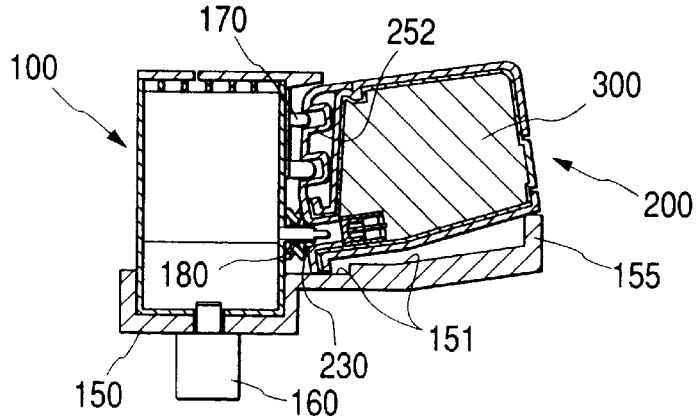

Then, as shown in FIG. 4B, the ink tank unit 200 is moved toward the negative pressure control chamber unit 100 so that the member 170 for ID is inserted into the concave portion 252 for ID and the joint pipe 180 is inserted into the joint port 230.

Figure 4C:
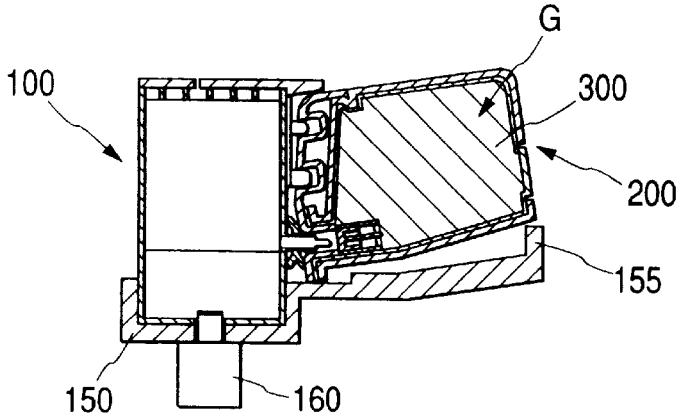

Then, because the ink tank unit 200 set to a predetermined position is provided for the position shown in FIG. 4C, that is, the position where the ID member 170 corresponds to the concave portion 252 for ID, it is further moved up to the inner part of the negative pressure control chamber unit-200 side. Moreover, when the ink tank unit 200 is rotated in the direction of the arrow G, the front end of the joint pipe 180 contacts the valve element 261 and the valve element 261 is pushed. Thereby, a valve-operating mechanism opens, the inside of the ink tank unit 200 is communicated with the inside of the negative pressure control chamber unit 100, and ink 300 in the ink tank unit 200 can be supplied into the negative pressure control chamber unit 100. Details of the opening/closing operation of the valve-operating mechanism will be described later.

Thereafter, the ink tank unit 200 is further rotated in the direction of the arrow G and inserted into the position shown in FIG. 2. Thereby, the rear lower portion of the ink tank unit 200 is secured to the ink-tank-securing portion 155 of the holder 150 and thus, the ink tank unit 200 is fixed to a desired position. Under such a state, the ID member 170 moves in a direction slightly separate from the concave portion 252 for ID. The backward (holder securing portion-155 side) energizing force for fixing the ink tank unit 200 is generated by the energizing member 263 in the ink tank unit 200 and the rubber joint portion 280 provided around the joint pipe 180.

As described above, because the concave portion 252 for ID is formed on the slope 251 in the ink tank unit 200 and moreover, the lower face of the ink tank unit 200 tilts, and thereby it is possible to securely set or remove the ink tank unit 200 in a minimum space without causing any erroneous setting or color mixing.

Figure 4D:
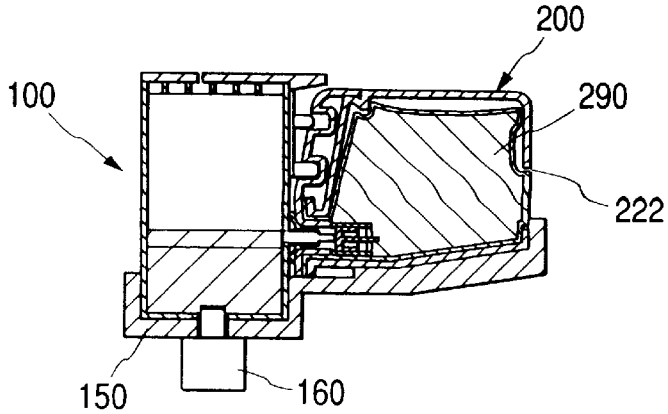

Thus, at the time of connecting the ink tank unit 200 with the negative pressure control chamber unit 100, ink moves until the pressure in the negative pressure control chamber unit 100 becomes equal to the pressure in the ink container 201 and as shown in FIG. 4D, an equilibrium state (referred to as a use start state) is realized while the pressure in the joint pipe 180 and that in the joint port 230 are negative.

Therefore, ink movement for the above equilibrium state to be realized will be described below in detail.

When the ink tank unit 200 is set and thereby, the valve-operating mechanism provided for the joint port 230 of the ink container 201 opens, the ink storage portion is substantially closed except the joint port 230. Then, the ink in the ink container 201 flows to the joint port 230 and an ink path is formed between the joint port 230 and the absorption body 140 of the negative pressure control chamber unit 100. When the ink path is formed, ink movement from the ink container 201 to the absorption body 140 is started due to a capillary force of the absorption body 140 and as a result, the interface of the ink in the absorption body 140 rises. Moreover, the inner bag 220 starts deformation with the central portion of a face having the maximum area so that the volume in the inner bag 220 decreases.

In this case, the housing 210 works so as to control displacements of corners of the inner bag 220. Therefore, an acting force of deformation due to ink consumption and an acting force for returning to the state before the inner bag 220 is set (an initial state shown in FIGS. 4A to 4C of this embodiment) are applied to the inner bag 220 to generate a negative pressure corresponding to a degree of deformation without sudden change. Because the space between the housing 210 and the inner bag 220 communicates with outside air through the outside-air communication port 222, air is introduced between the housing 210 and the inner bag 220 in accordance with the above deformation.

However, even if air is present in the joint port 230 and joint pipe 180, the air easily moves into the inner bag 220 because the inner bag 220 is deformed due to discharge of ink when the ink in the ink container 201 contacts the absorption body 140 and thereby, an ink path is formed.

Ink movement continues until the static negative pressure in the joint port 230 of the ink container 201 becomes equal to the static negative pressure in the joint pipe 180 of the negative pressure control chamber unit 100.

As described above, movement of ink from the ink container 201 to the negative pressure control chamber unit 100, when the ink container 201 is connected with the negative pressure control chamber unit 100, is performed without introducing any gas into the ink container 201 through the absorption bodies 130 and 140. It is permitted to set the static negative pressure of each chamber when an equilibrium state is realized to a proper value in accordance with the type of liquid discharge recording means to be connected so that ink does not leak from liquid discharge recording means such as the ink-jet head unit 160 or the like connected to the ink supply port of the negative pressure control chamber unit 100.

Moreover, because an ink quantity held by the absorption body 130 before connection fluctuates, an area in which the absorption body 140 is not filled with ink may be left even when an equilibrium state is realized. This area can be used as a buffer area On the contrary, when it is feared that pressures in the joint pipe 180 and joint port 230 under an equilibrium state may become positive, it is permitted to perform attraction recovery by the attraction recovery means to be mentioned later provided for a liquid discharge recorder and thereby slightly discharge ink.

As described above, the ink tank unit 200 of this embodiment is set to the holder 150 almost in accordance with the almost rotating operation in which the unit 200 is diagonally inserted while putting the outer bottom of the unit 200 on the ink-tank securing portion 155 of the holder 150 and inserted into the bottom of the holder 150 after getting over the ink-tank securing portion 155. Moreover, the ink tank unit 200 is taken out of the holder 150 by reversing the above operation. Then, the valve-operating mechanism provided for the ink tank unit 200 is opened or closed in accordance with setting or removing of the ink tank unit 200.

<Opening/closing operation of valve-operating mechanism>

Opening/closing operation of a valve-operating mechanism will be described below by referring to FIGS. 5A to 5E.

Figure 5A:
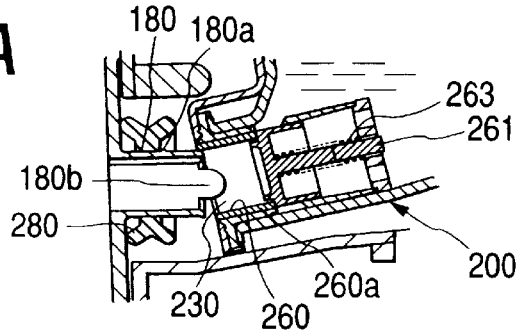
FIGS. 5A, 5B, 5C, 5D and 5E are sectional views for explaining opening/closing operation of a valve operating mechanism that can be applied to the present invention.

FIG. 5A shows a state just before the ink tank unit 200 is diagonally inserted into the holder 150 by turning the joint port 230 diagonally downward and the joint pipe 180 is inserted into the joint port 230.

In this case, a sealing protrusion 180*a* is integrally set over the whole outer periphery of the joint pipe 180 and a valve-opening/closing protrusion 180*b* is set to the front end of the pipe 180. The sealing protrusion 180*a* contacts a joint sealing face 260 of the joint port 230 when the joint pipe 180 is inserted into the joint port 230, which is diagonally set so that the distance from the front end of the joint pipe 180 at the upper end becomes larger than that at the lower end.

Because the sealing protrusion 180*a* slides on the joint sealing face 260 at the time of setting or removing the ink tank unit 200 as described later, it is preferable to use a material having a high sliding property and a high adhering property with the joint sealing face 260 for the sealing protrusion 180*a*. Moreover, the form of the energizing member 263 for energizing the valve element 261 toward the first valve frame 260*a* is not specifically restricted. It is possible to use a spring member such as a coil spring or flat spring or a flexible member such as rubber. Furthermore, at the time of considering the recycling property, it is preferable to use an elastic member made of resin.

Under the state shown in FIG. 5A, the valve opening/closing protrusion 180*b* does not contact the valve element 261 but a sealing portion formed on the outer periphery of the end of the valve element 261 at the joint pipe-180 side is pressed against the sealing portion of the first valve frame 260*a* by the energizing force of the energizing member 263. Thereby, the airtightness in the ink tank unit 200 is maintained.

Figure 5B:
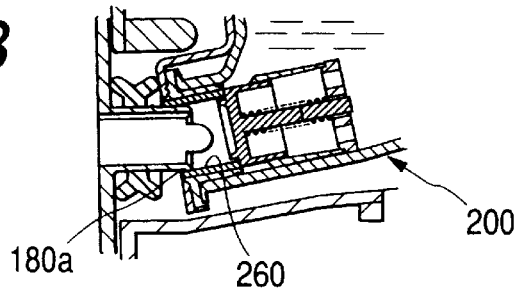
Figure 5C:
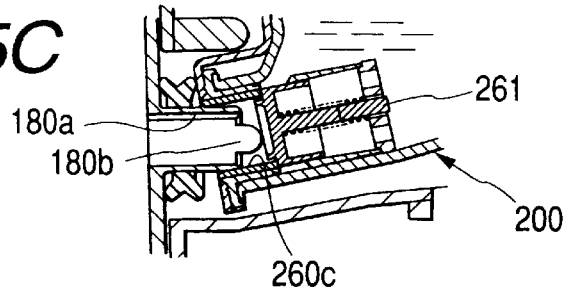
Figure 5D:
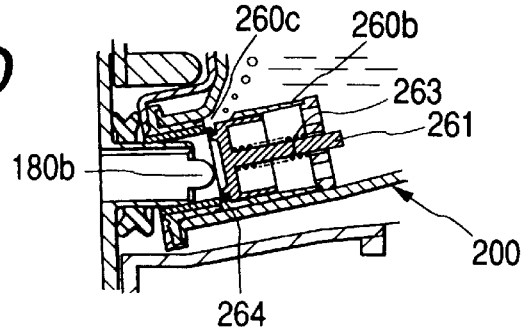

By further inserting the ink tank unit 200 into the holder 150, the joint sealing face 260 of the joint port 230 is sealed by the sealing protrusion 180*a*. In this case, because the sealing protrusion 180*a* is diagonally set as described above, the lower end of the sealing protrusion 180*a* first contacts the joint sealing face 260, the contact range between the lower end and the joint sealing face 260 slowly expands toward the upper portion of the sealing protrusion 180*a* while the lower end slides on the joint sealing face 260 because the ink tank unit 200 is inserted as shown in FIG. 5B, and finally the upper end of the sealing protrusion 180*a* contacts the joint sealing face 260 as shown in FIG. 5C. Thereby, the overall circumference of the sealing protrusion 180*a* contacts the joint sealing face 260 and the joint port 230 is sealed by the sealing protrusion 180*a*.

Moreover, under the state shown in FIG. 5C, the valve opening/closing protrusion 180*b* does not contact the valve element 261 and thus, the valve-operating mechanism does not open. Therefore, because the joint port 230 is sealed before the valve-operating mechanism opens, it is possible to prevent ink from leaking from the joint port 230 while the ink tank unit 200 is set.

Furthermore, because the joint port 230 is slowly sealed from the lower side of the joint sealing face 260 as described above, the air in the joint port 230 is exhausted from the gap between the sealing protrusion 180*a* and the joint sealing face 260 before the joint port 230 is sealed by the sealing protrusion 180*a*. Thus, because the air is exhausted from the joint port 230, the quantity of the air remaining in the joint port 230 is minimized while the joint port 230 is sealed and excessive compression of the air in the joint port 230 due to insertion of the joint pipe 180 into the joint port 230, that is, excessive rise of the pressure in the joint port 230 is prevented. As a result, it is possible to prevent the valve from being carelessly opened due to a pressure rise in the joint port 230 and ink from entering the joint port 230 due to careless opening of the valve.

By further inserting the ink tank unit 200, the valve opening/closing protrusion 180*b* pushes the valve element 261 against the energizing force of the energizing member 263 while the joint port 230 is sealed by the sealing protrusion 180*a*. Thereby, an opening 260*c* of the second valve frame 260*b* communicates with the joint port 230, the air in the joint port 230 is introduced into the ink tank unit 200 after passing through the opening 260*c*, the ink in the ink tank unit 200 is supplied to the negative pressure control chamber container 110 (refer to FIG. 2) after passing through the opening 260*c* and joint pipe 180.

Thus, because the air in the joint port 230 is introduced into the ink tank unit 200, a negative pressure in the inner bag 220 (refer to FIG. 2) is moderated, for example, at the time of resetting the ink tank unit 200 currently used. Therefore, the balance between negative pressures of the negative pressure control chamber container 110 and inner bag 220 is improved and it is possible to prevent the resupply performance of ink to the negative pressure control chamber container 110 from deteriorating.

Figure 5E:
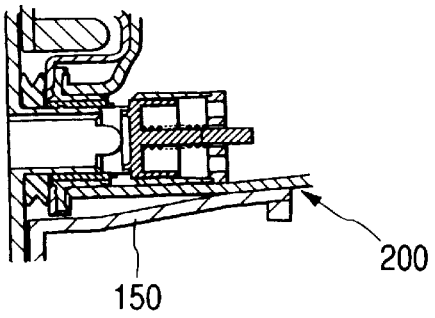

After the above operations, by inserting the ink tank unit 200 into the bottom of the holder 150 and setting the ink tank unit 200 to the holder 150 as shown in FIG. 5E, the joint port 230 and joint pipe 180 are completely connected each other and a state is ready in which the above-described gas-liquid change is securely performed.

In case of this embodiment, the opening 260*c* is set to the second valve frame 260*b* nearby a valve-frame sealing portion 264 at the bottom side of an ink tank. According to the configuration of this opening 260*c*, when the valve-operating mechanism opens, that is, the valve element 261 is pressed by the valve opening/closing protrusion 180*b* and immediately after the element 261 is moved toward the valve lid 262, supply of the ink in the ink tank unit 200 to the negative pressure control chamber unit 100 is started and it is possible to minimize the quantity of ink remaining in an ink tank when ink is consumed.

Moreover, in case of this embodiment, elastomer is used as a material for configuring the joint sealing face 260 of the first valve frame 260*a*, that is, the sealing portion of the first valve frame. Thus, by using the elastomer as the material, the joint sealing face 260 can secure a certain sealing performance with the sealing protrusion 180*a* of the joint pipe 180 according to the elasticity of the elastomer and the sealing portion of the first valve frame 260*a* can secure a certain sealing performance with the sealing portion of the valve element 261. Moreover, the elastomer used as a material can be integrated with the first valve frame 260*a* and therefore, the above effect can be obtained without increasing any number of components. Furthermore, a portion using elastomer as a material is not restricted to the above configuration. It is also permitted to use elastomer as a material of the sealing protrusion 180*a* formed on the joint pipe 180 or a material of the sealing portion of the valve element 261.

On the other hand, if the ink tank unit 200 is removed from the holder 150, cancel of sealing of the joint port 230 and operations of the valve-operating mechanism are performed in the sequence reverse to the sequence of the above operations.

That is, by removing the ink tank unit 200 from the holder 150 while rotating the unit 200 inversely to the direction when setting the unit 200, the valve element 261 is first advanced by the energizing force of the energizing member 263 and then, the sealing portion of the valve element 261 is pressed against the sealing portion of the first valve frame 260*a* and thereby, the joint port 230 is closed by the valve element 261.

Thereafter, by further removing the ink tank unit 200, sealing of the joint port 230 is canceled by the sealing protrusion 180*a*. Thus, because sealing of the joint port 230 is canceled after the valve-operating mechanism is closed, excessive ink is not supplied to the joint port 230.

Moreover, because the sealing protrusion 180*a* is diagonally set as described above, sealing of the joint port 230 is canceled starting with the upper end of the sealing protrusion 180*a*. Before sealing of the joint port 230 is canceled, ink is left in the joint port 230 and joint pipe 180. However, ink does not leak from the joint port 230 because the upper end of the sealing protrusion 180*a* is first released but the lower end of it is still sealed. Moreover, because insides of the joint port 230 and joint pipe 180 are kept at a negative pressure, when the upper end of the sealing protrusion 180 is released, atmospheric air enters the joint port 230 through the upper end and the ink left in the joint port 230 and joint pipe 180 is attracted into the negative pressure control container 110.

Thus, by releasing the upper end of the sealing protrusion 180*a* before canceling sealing of the joint port 230 and moving the ink left in the joint port 230 to the negative pressure control container 110, ink is prevented from leaking from the joint port 230 when removing the ink tank unit 200 from the holder 150.

As described above, according to the connection structure between the ink tank unit 200 and negative pressure control container 110 of this embodiment, the joint port 230 is sealed before the valve-operating mechanism of the ink tank unit 200 operates. Therefore, it is possible to prevent ink from carelessly leaking from the joint port 230. Moreover, by setting a time difference between sealing timing and sealing cancel timing at the upper portion and lower portion when connecting and removing the unit 200, it is possible to prevent a careless operation of the valve element 261 when connecting the ink tank unit 200 and the ink left in the joint port 230 from leaking when removing the unit 200.

Moreover, in case of this embodiment, the valve element 261 is set to the back of the opening end of the joint port 230 and the valve element 261 is operated by the valve opening/closing protrusion 180*b* at the front end of the joint pipe 180. Therefore, a user does not directly touch the valve element 261. Thus, it is possible to prevent the user from being contaminated by the ink attached to the valve element 261.

Figure 12:
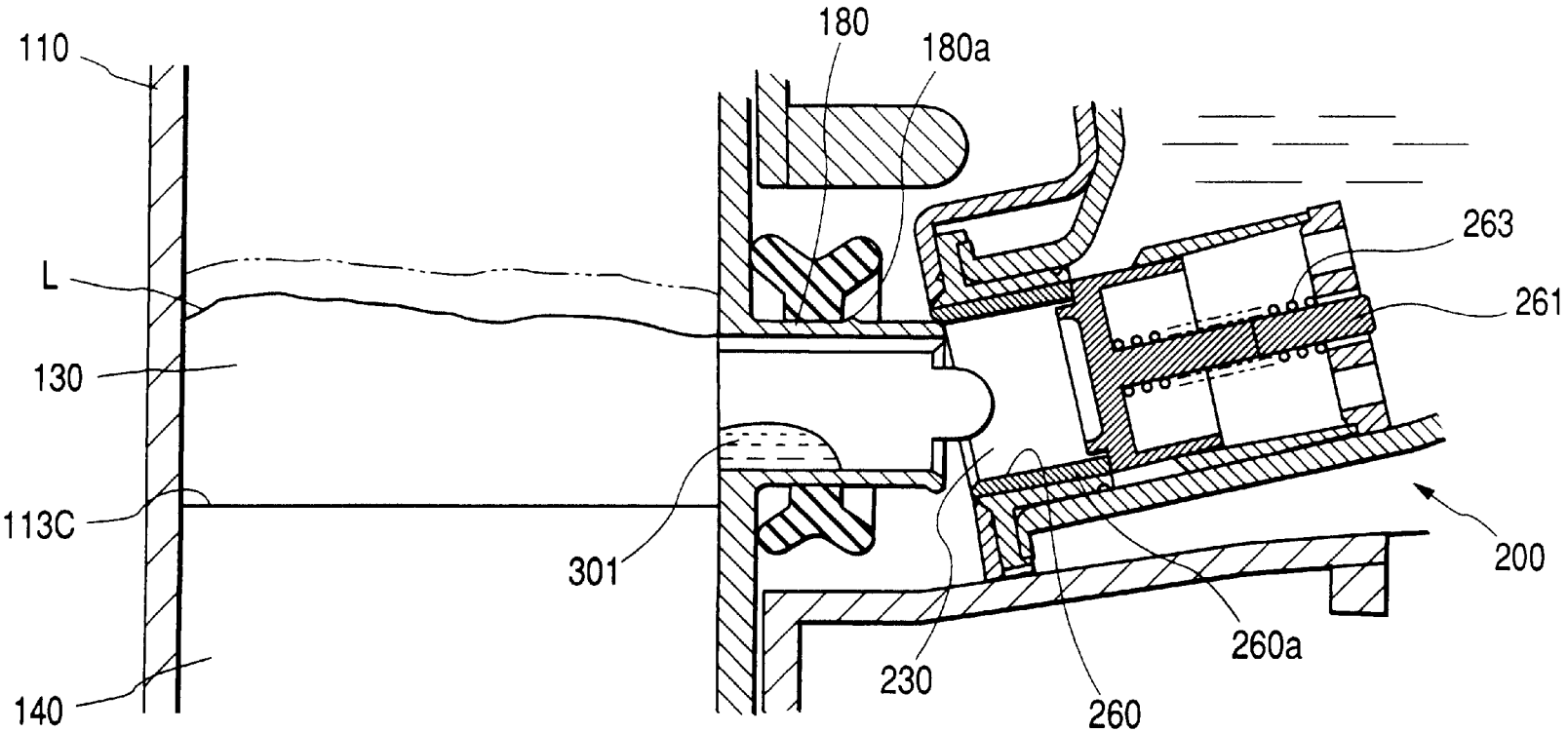
FIG. 12 is an illustration showing a state in which the ink tank unit of the ink-jet cartridge shown in FIG. 2 is removed.

Furthermore, in case of this embodiment, the contact face 113*c* between the absorption bodies 130 and 140 is formed below the lower end of the joint pipe 180. Therefore, as shown in FIG. 12, the gas-liquid interface L rises in the absorption body 130 as remaining ink 301 is further absorbed. Therefore, as shown for the conventional example, when the gas-liquid interface L reaches the contact face 113*c* between the absorption bodies 130 and 140, the ink absorption rate is not lowered and therefore, the remaining ink 301 can be smoothly absorbed. Moreover, because the remaining ink is absorbed from the contact face with the upper absorption body 130 having a comparatively-low fiber density and a small dynamic resistance of ink, the absorption rate increases compared to the case in which ink is absorbed from the contact face with the lower absorption body 140 having a comparatively-large dynamic resistance of ink. Therefore, because the absorption rate of the ink 301 is small, it is possible to prevent the ink from fixing in the joint pipe 180 or splashing outward.

<Relation between setting/removing operation of joint portion and ID>

Then, the relation between setting/removing operation of a joint portion and ID will be described below by referring to FIGS. 4A to 4D and FIGS. 5A to 5E. FIGS. 4A to 4D and FIGS. 5A to 5E are illustrations showing the steps of setting the ink tank unit 200 to the holder 150, in which FIGS. 4A, 4B, and 4C show states of ID and FIGS. 5A, 5B, and 5C show details of the joint portion at the same period.

First, setting operation is performed up to positions shown in FIG. 4A and FIG. 5A, that is, positions at which a plurality of ID members 170 for preventing the ink tank unit 200 provided for the negative pressure control chamber unit 100 from being erroneously inserted contacts the ink-tank slope 251. At this point of time, the joint port 230 does not contact with the joint pipe 180. If an erroneous ink tank unit is set at this point of time, the slope 251 interferes with the ID member 170 to prevent other ink tank units from being set. According to this configuration as described above, because the joint port 230 does not contact with the joint pipe 180 at all, it is possible to prevent mixing of various color inks, fixing of ink, or non-discharge of ink at the joint portion, an image defect, a system trouble, or unnecessary change of heads of an ink-tank-change-type system when an erroneously ink tank unit is set.

Then, because the ink tank unit 200 set to a correct position is set to the position shown in FIG. 4B, that is, the position at which the ID member 170 corresponds to the concave portion 252 for ID, it can be further inserted up to (the negative pressure control chamber unit-100 side). In case of the ink tank unit 200 inserted up to the above position, the joint port 230 and the lower end of the sealing protrusion 180*a* of the joint pipe 180 contact the sealing face 260 of the joint port 230.

Subsequently, the joint portion is connected in accordance with the above steps and the inside of the ink tank unit 200 is communicated with the inside of the negative pressure control chamber unit 100.

In case of the above embodiment, the sealing protrusion 180*a* is integrally provided for the joint pipe 180. However, it is also permitted to use a configuration in which the sealing protrusion 180*a* and the joint pipe 180 are constituted separately from each other so that the sealing protrusion 180*a* can rotate about the joint pipe 180 by making the sealing protrusion 180*a* almost engage with a convex or concave portion formed around the joint pipe 180. However, the movable range of the sealing protrusion 180*a* is designed so that the valve-element opening/closing protrusion 180*b* does not contact the valve element 261 before the sealing protrusion 180*a* in the movable range completely contacts with the joint sealing face 260 when the ink tank 200 is set to the holder 150.

As for the step in which the ink tank unit 200 is set to the holder 150, it is shown in the case of the above embodiment that the lower end of the sealing protrusion 180*a* contacts the joint sealing face 260, the contact range between the lower end and the face 260 slowly expands toward the upper portion of the sealing protrusion 180 while the ink tank unit 200 slides on the joint sealing face 260 in accordance with insertion of the unit 200, and finally the upper end of the sealing protrusion 180*a* contacts the joint sealing face 260. However, it is also permitted that the upper end of the sealing protrusion 180*a* contacts the joint sealing face 260, the contact range between the upper end and the face 260 slowly expands toward the lower portion of the sealing protrusion 180*a* while the upper end slides on the joint sealing face 260 in accordance with insertion of the ink tank unit 200, and finally the lower end of the sealing protrusion 180*a* contacts the joint sealing face 260. Moreover, it is permitted that the lower end and the upper end contact at the same time. In this case, even if the air present between the joint pipe 180 and the valve element 261 pushes the valve element 261 and thereby, the valve element 261 opens, the ink 300 in the container 201 does not leak out of it because the joint port 230 is completely sealed by the sealing protrusion 180*a* and joint sealing face 260. That is, it is a point of the present invention that the joint pipe 180 and joint port 230 are completely sealed and thereafter, the valve-operating mechanism is released. According to the above configuration, the ink 300 in the ink tank does not leak outward when the ink tank unit 200 is set. Moreover, the pushed air enters the ink tank unit 200 and pushes out the ink 300 to the joint port 230. Therefore, the ink is quickly supplied to the absorption body 140 from the ink container 201.

<Ink supply operation>

Then, the ink supply operation by the ink-jet head cartridge shown in FIG. 2 is described below by referring to FIG. 6. FIG. 6 is a sectional view for explaining the ink supply operation by the ink-jet head cartridge shown in FIG. 2.

As described above, by diving the absorption body in the negative pressure control chamber unit 100 into a plurality of members, it is possible to consume the ink in the upper absorption body 130 and then consume the ink in the lower absorption body 140 when ink is present in both the absorption bodies 130 and 140 of the ink-jet head cartridge shown in FIG. 2. Moreover, when the gas-liquid interface L lowers due to an environmental change or consumption of ink, the ink in the absorption body 130 and the ink nearby the contact face 113*c* between the absorption bodies 130 and 140 are initially consumed and then, the ink in the absorption body 140 is consumed. Therefore, a phenomenon hardly occurs that a part of the gas-liquid interface L lowers and reaches the supply port 131 and thereby, ink shortage occurs. Moreover, when the gas-liquid interface L rises due to an environmental change, the gas-liquid interface L rises while keeping a state parallel with the fiber direction of the absorption body 140. Therefore, it is possible to stably secure buffer areas other than the buffer space 116 in the negative pressure control chamber unit 100. Moreover, as described for this embodiment, by increasing the capillary force of the absorption body 140 compared to the capillary force of the absorption body 130, it is possible to completely consume the ink in the upper absorption body 130 under operation.

Furthermore, in the case of this embodiment, the absorption bodies 130 and 140 contact each other at the contact face 113*c* because the absorption body 130 is pressed against the absorption body 140 by a rib of the negative pressure control chamber lid 120. Therefore, portions nearby the contact face 113*c* between the absorption bodies 130 and 140 have a compression rate and a capillary force higher than those of other portions. That is, when assuming the capillary of the absorption body 140 as P1, the capillary force of the absorption body 130 as P2, and the capillary force of the contact face 113*c* between the absorption bodies 130 and 140 and an area (boundary layer) nearby the contact face 113*c* as PS, the following expression is obtained: P2<P1<PS. Thus, by forming the boundary layer having a large capillary force, it is possible to securely show the above-mentioned effect because the interface has a capillary force meeting the above condition even if capillary force ranges of P1 and P2 considering the fluctuation of density are overlapped each other due to the fluctuation of densities in the absorption bodies 130 and 140. Moreover, as described above, setting the joint pipe 180 nearby the lower portion of the contact face 113*c* between the absorption bodies 130 and 140 is preferable because a liquid level at the time of gas-liquid change can be stably kept at the position.

Then, a method for constituting the contact face 113*c* of this embodiment is described below. In case of this embodiment, as the material of the absorption body 140 serving as a capillary force generating member, olefin-based resin fiber (2-denier) having a capillary force P1 of −110 mmAq is used and has a hardness of 0.69 kgf/mm. In this case, hardnesses of the absorption bodies 130 and 140 are obtained by measuring a repulsion when inserting a push rod with a diameter of 15 mm into an absorption body while the bodies 130 and 140 are stored in the negative pressure control chamber container 110 and measuring a gradient of the repulsion to the insertion value of the push rod. Moreover, as the material of the absorption body 130, olefin-based resin fiber same as that of the absorption body 140 is used. However, P2 of the absorption body 130 is weak compared to the case of the absorption body 140 and the capillary force P2 is equal to −80 mmAq, the diameter of the fiber material is thick (6-denier), and the absorption body 130 has a high rigidity of 1.88 kgf/mm.

Thus, by making the absorption body 130 having a low capillary force harder than the absorption body 140 having a high capillary force and bringing them into contact with each other and combining them, the absorption body 140 is crushed nearby the contact face 113*c* between the absorption bodies 130 and 140 and it is possible to set the capillary forces so as to meet P2<P1<PS. Moreover, it is possible to make the difference between P2 and PS equal to or larger than the difference between P2 and P1 without fail.

<Ink-jet head cartridge>

Figure 9:
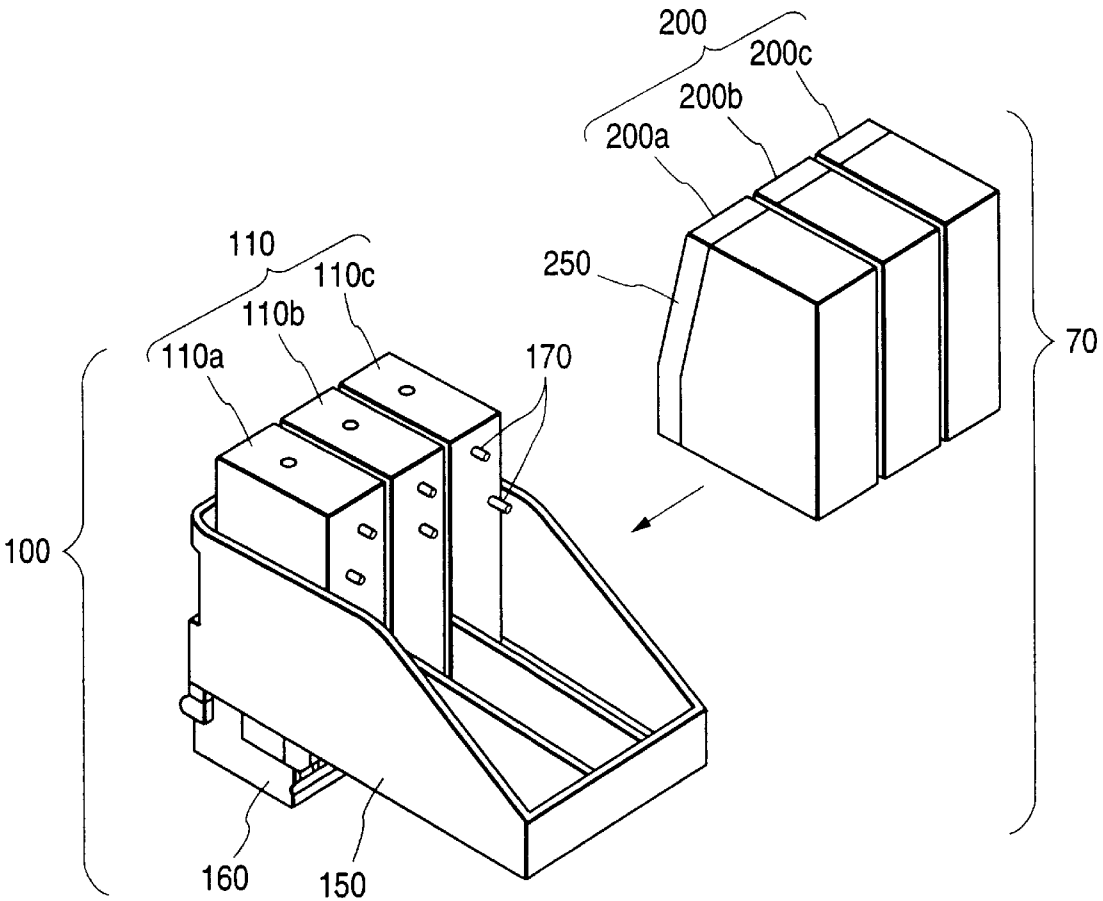
FIG. 9 is a schematic illustration of the ink-jet head cartridge using the ink tank unit that can be applied to the present invention.

FIG. 9 is a schematic illustration of an ink-jet head cartridge using an ink tank unit that can be applied to the present invention.

The ink-jet head cartridge 70 having the configuration shown in FIG. 9 is provided with a negative pressure control chamber unit 100 in which negative pressure control chamber containers 110*a*, 110*b*, and 110*c* respectively storing a liquid are integrated with an ink-jet head unit 160 capable of discharging a plurality of liquids (three colors of yellow (Y), magenta (M), and cyan (C) in the case of this embodiment) so that ink tank units 200*a*, 200*b*, and 200*c* respectively storing a liquid can be set to or removed from the negative pressure control chamber unit 100.

To correctly set the ink tank units 200*a*, 200*b*, and 200*c* to their corresponding negative pressure control chamber containers 110*a*, 110*b*, and 110*c*, this embodiment is constituted so as to securely prevent erroneous setting by setting a holder 150 for covering a part of the outer face of the ink tank unit 200, an ID member 250 having a concave portion at the front of the ink tank unit 200 in the setting direction, and a convex ID member 170 corresponding to the concave portion of the ID member 250 to the negative pressure control chamber container 110.

In case of the present invention, it is needless to say that types of liquids to be stored can use colors other than Y, M, and C and the number of liquid containers to be stored and a combination of them (for example, only black (Bk) is stored in an independent tank and other Y, M, and C are stored in an integrated tank) is optional.

<Recorder>

Finally, an ink-jet recorder on which the above ink tank unit or ink-jet head cartridge can be mounted is described below by referring to FIG. 10.

Figure 10:
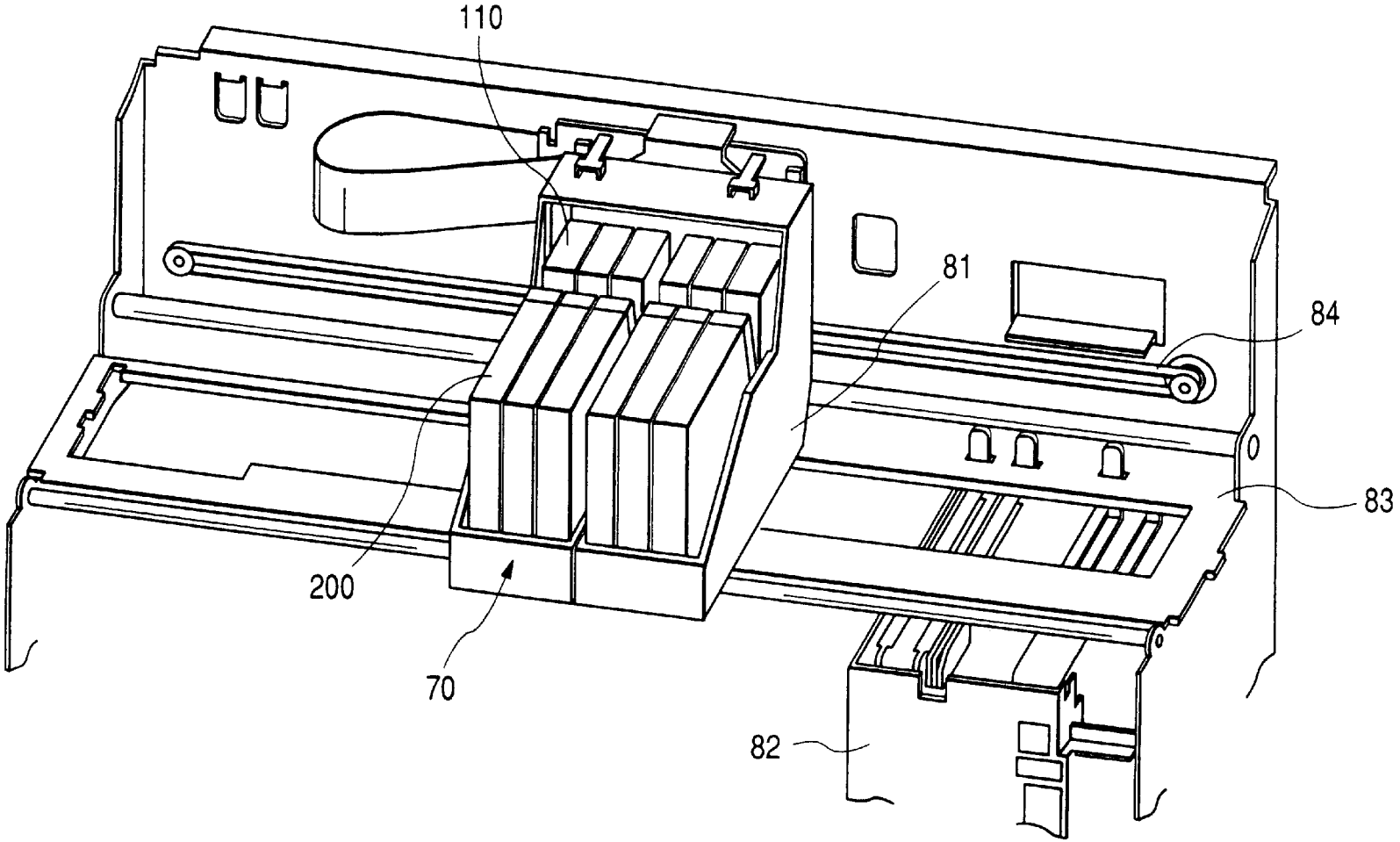
FIG. 10 is an illustration showing a schematic configuration of a recorder to which the ink-jet head cartridge of the present invention can be applied.
Figure 11:
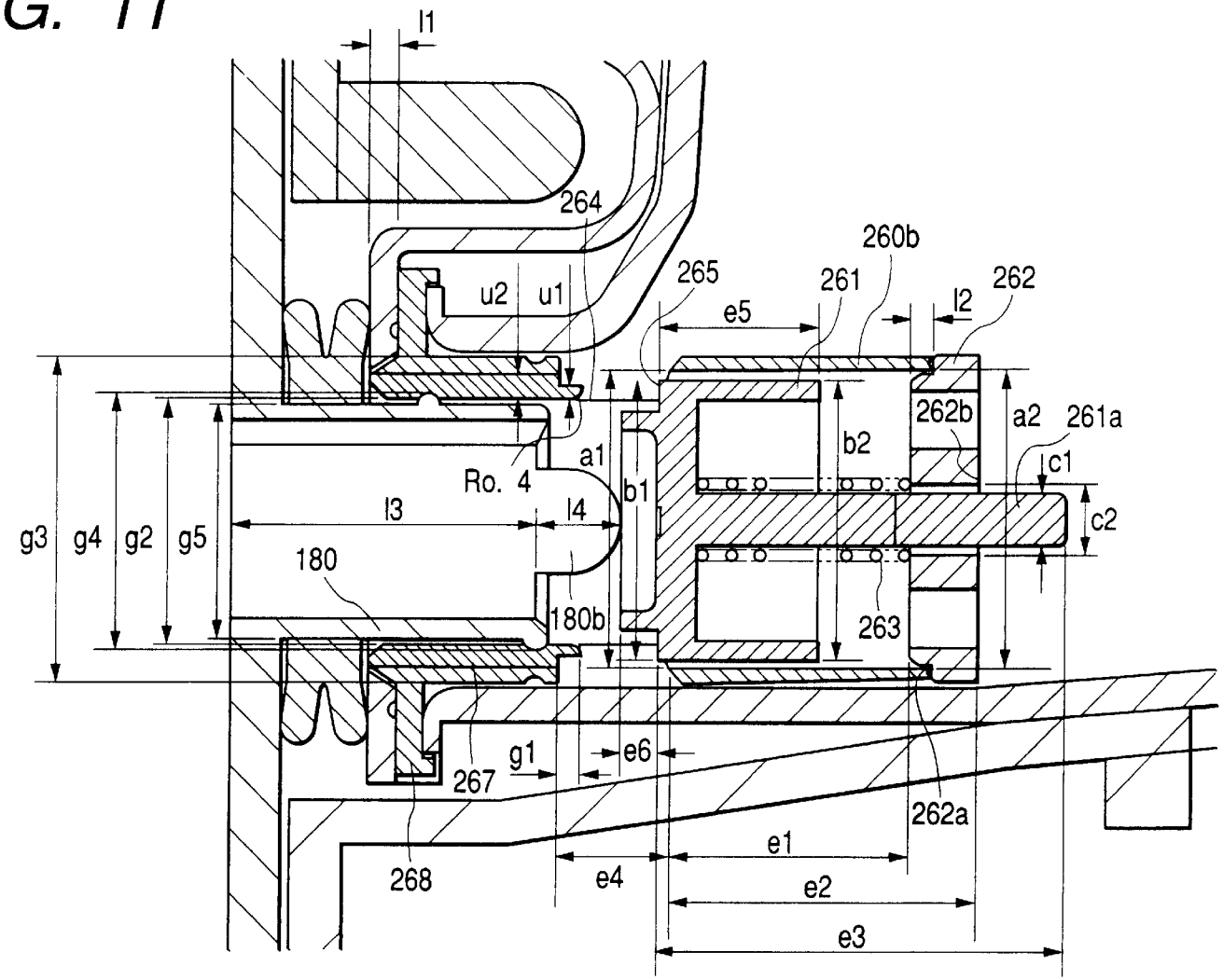
FIG. 11 is an illustration for explaining dimensions of components of a joint of the ink tank unit that can be applied to the present invention.

The recorder shown in FIG. 10 comprises a carriage 81 on which an ink tank unit 200 and an ink-jet head cartridge 70 can be removably mounted; a head recovery unit 82 in which a head cap for preventing the ink discharged from a plurality of orifices of a head from drying and an attraction pump for attracting the ink discharged from the orifices when the head malfunctions are built; and a sheet supply face 83 to which a recording sheet serving as a recording medium is carried.

The carriage 81 uses a position on the recovery unit 82 as the home position, which is scanned leftward in FIG. 10 when a belt 84 is driven by a motor or the like. During the above scanning, printing is performed by discharging ink toward a recording sheet carried onto the sheet supply face (platen) 83 from the head.

A valve-operating mechanism of the present invention can be most preferably used for the above liquid container. However, the shape of the liquid container is not restricted to the above shape. It is possible to apply the mechanism to other container for directly storing liquid at a supply port.

Second Embodiment

Figure 13:
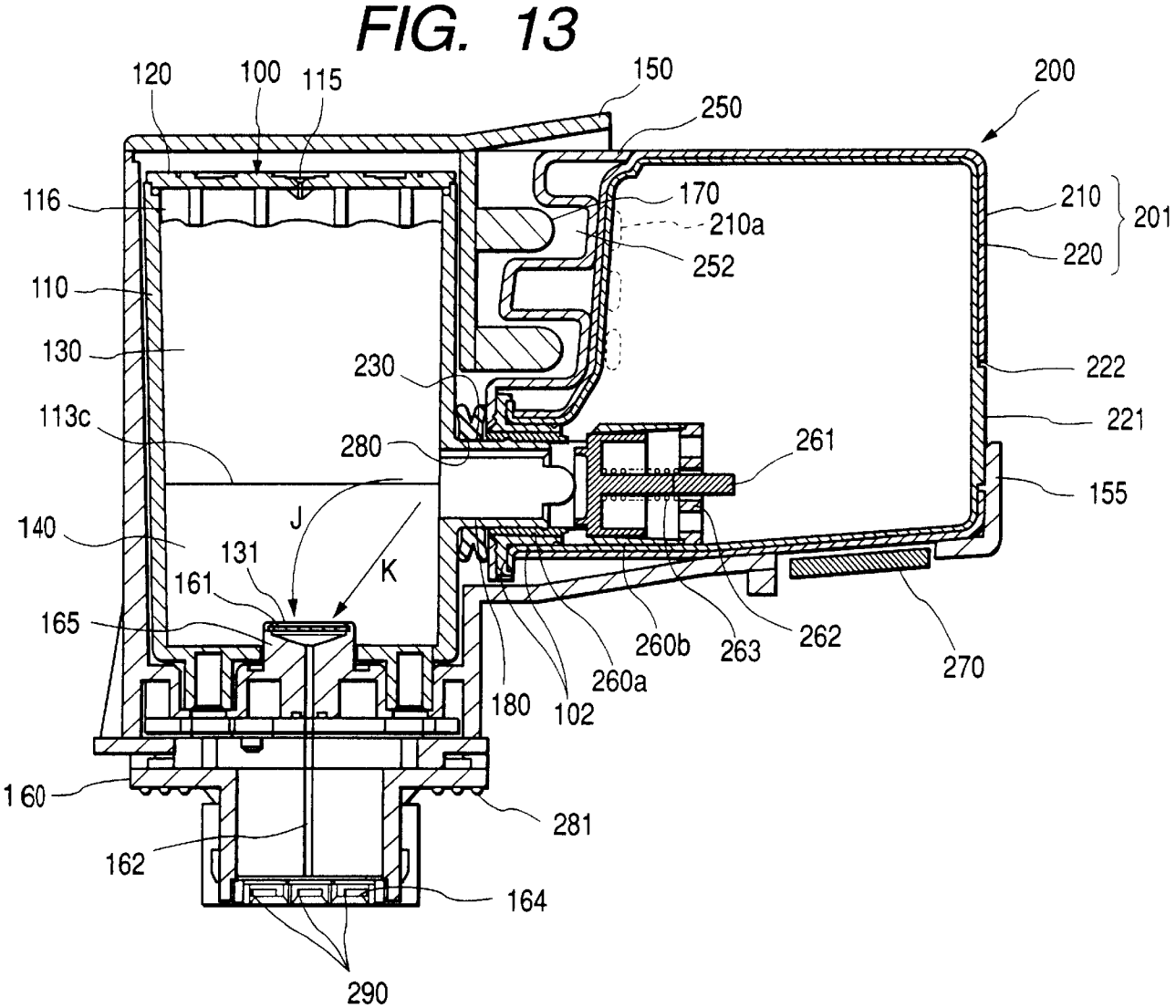
FIG. 13 is a sectional view showing the ink-jet head cartridge of a second embodiment according to the present invention.

FIG. 13 shows a sectional view of an ink-jet head cartridge of a second embodiment of the present invention. In FIG. 13, a component same as that of the first embodiment is provided with the same symbol and its description is omitted.

In case of this embodiment, the contact face 113*c* between absorption bodies 130 and 140 is formed between the upper and lower ends of a joint pipe 180. Under the normal operating state, a gas-liquid interface L is formed nearby the upper end of the joint pipe 180. Therefore, also in this configuration, the gas-liquid interface L is formed in the absorption body 130 above the contact face 113*c*. Therefore, when an ink tank unit 200 is removed, the ink remaining in the joint pipe 180 is absorbed in a negative pressure control chamber container as the gas-liquid interface L rises through the absorption body 130. Therefore, as shown for the conventional example, when the gas-liquid interface L reaches the contact face 113*c*, the ink absorption rate does not lower and thereby, it is possible to smoothly absorb the remaining ink.

Moreover, in case of this embodiment, an absorption body 141 having a capillary force higher than that of the absorption body 140 is formed on a portion contacting with a supply port 131 by being brought into contact with the absorption body 140. Therefore, it is possible to efficiently introduce the ink reaching the vicinity of the supply port 131 by a capillary force of the absorption body 141. Furthermore, by forming the absorption body 141 of a fiber body having the main fiber direction in the vertical direction in FIG. 13, it is possible to decrease the dynamic resistance of the ink toward the supply port 131 and efficiently introduce the ink into the supply port 131.

Third Embodiment

Figure 14:
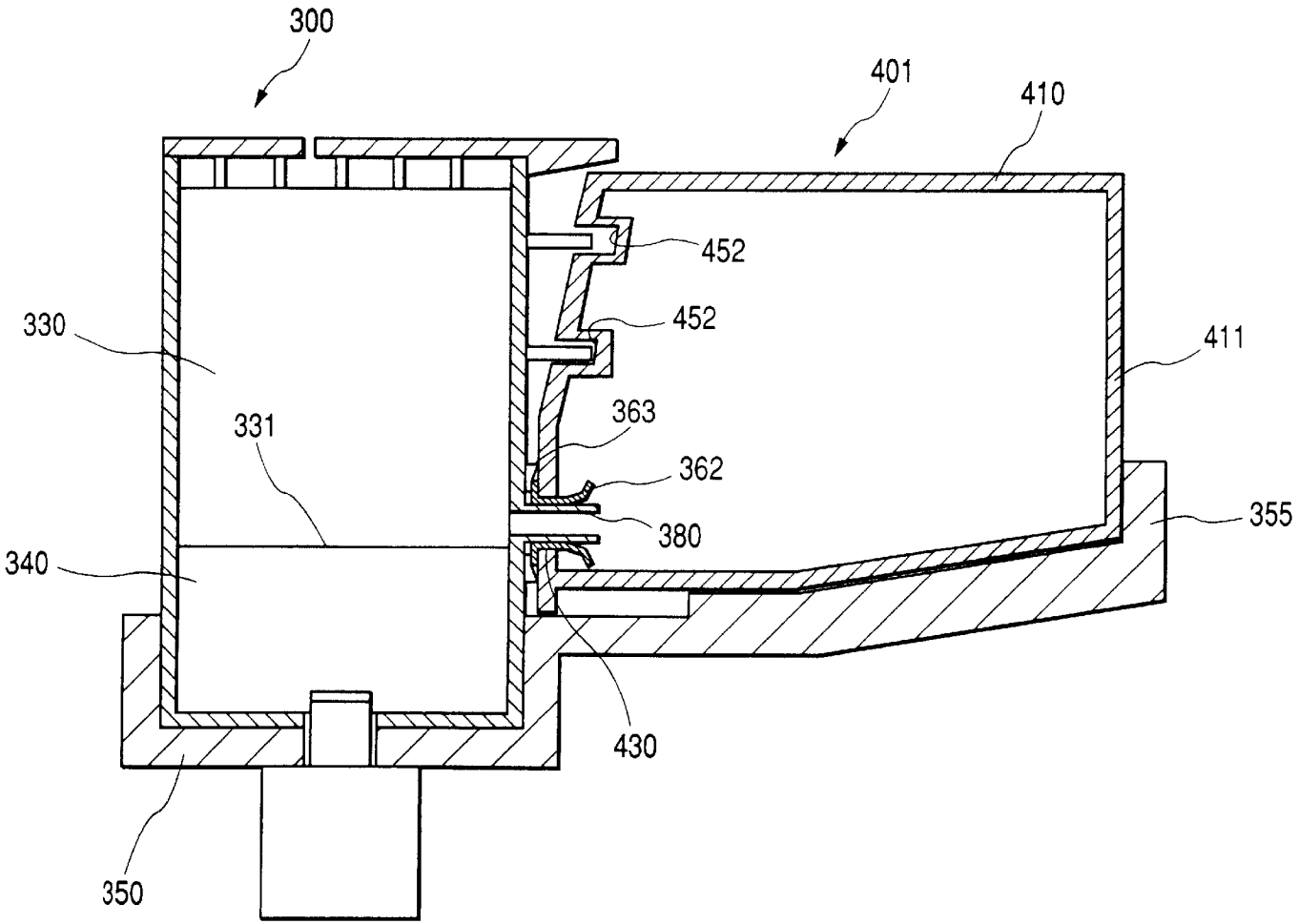
FIG. 14 is a sectional view showing the ink-jet head cartridge of a third embodiment according to the present invention.

FIG. 14 shows a sectional view of an ink-jet head cartridge of a third embodiment of the present invention. This embodiment is different from the first and second embodiments in the shape of a liquid supply container.

Moreover, FIG. 14 shows a state in which an ink container 401 is held by a holder 350 having a negative pressure control chamber unit 300 so as to be removably from the holder 350. As shown in FIG. 14, in case of an ink-jet head cartridge of this embodiment, the ink container 401 comprises an integrated-structure housing 410 in which a concave portion 452 for ID corresponding to two ID members provided for the negative pressure control chamber unit 300 is formed at two places and a joint port 330 serving as an ink supply port and fitted to a joint pipe 380 of the negative pressure control chamber unit 300 is formed and stores ink. Moreover, the ink container 401 completely keeps an airtight state because the joint port 330 is sealed by a film seal 362 when the container 401 is not set to the holder 350.

Moreover, an O ring 363 is set to the root of the joint pipe 380. The O ring 363 generates an energizing force for pressing the lower portion of the back 411 of the ink container 401 against an ink-tank securing portion 355 of the holder 350 when the ink container 401 is set to the negative pressure control chamber unit 300.

A gap is formed between the inner periphery of the joint port 330 and the outer periphery of the joint pipe 380, which makes it possible to hold the film sheet 362 pierced by the joint pipe 380 and folded to the inside of the housing 410 of the ink container 401 between the inner periphery of the joint port 330 and the outer periphery of the pipe 380. The O ring 363 not only generates the above-described energizing force but also prevents the ink stored in the ink container 401 from leaking from the gap formed between the inner periphery of the joint port 330 and the outer periphery of the joint pipe 380. Because the negative pressure control chamber unit 300 serving as a capillary force generating member storage chamber is the same as the negative pressure control chamber unit 100 of the first embodiment except the portion relating to the joint pipe 380, its detailed description is omitted.

In this case, the ink container 401 is made of a material not having an inner bag 220 deformed due to a negative pressure generated in a container such as the ink container 201 of the first embodiment and hardly deformed due to a negative pressure generated in a container. Therefore, the ink container 401 of this embodiment does not have an effect by an inner wall 220 described for the first embodiment.

However, by applying the present invention also to the ink container 401, it is possible to solve the above technical problem about setting/removing.

Moreover, it is permitted to change the shape of the capillary force generating member storage chamber shown for the first embodiment to the shape of that of the second embodiment. In this case, almost the same advantage as the case of the second embodiment can be obtained about setting/removing of the ink container 401. However, to solve various problems on setting/removing, the first and second embodiment is superior in adaptability for a synthetic ink supply performance and an environmental change. Therefore, as a result, configurations of the first and second embodiments are more preferable than the configuration of the third embodiment.

As described above, the present invention provides a liquid supply method using a liquid supply system including a liquid supply container having a liquid storage portion for storing liquid in a closed space; at least two capillary force generating members removable from the liquid supply container, capable of storing liquid, made of fibers, and contacted each other; an atmospheric air communication portion for communicating with atmospheric air; and a capillary force generating member container having a liquid supply portion for supplying liquid to the outside; in which it is possible to smoothly absorb the liquid remaining in a communication portion for communicating the liquid supply container with the capillary force generating member in the capillary force generating member container when removing the liquid supply container from the capillary force generating member container by setting the upper end of the communication portion above the contact face between the two capillary force generating members.

Moreover, it is possible to provide a liquid supply method making it possible to consume the ink in an upper capillary force generating member and thereafter consume the ink in a lower capillary force generating member, immediately stabilize the gas-liquid interface of injected ink by connecting a liquid supply container to a capillary force generating member container, and stably supply ink.

What is claimed is:

1. A liquid supply system comprising:

a capillary force generating member container having a capillary force generating member for storing liquid, an atmospheric air communication portion for communicating the capillary-force generation member with atmospheric air, a liquid supply portion for supplying liquid to an outside thereof, and a liquid communication portion for introducing liquid into said capillary force generating member container; and a liquid supply container having a liquid storage portion settable to and removable from the capillary force generating member container and which stores liquid in a space closed except for a connection portion connectable to the liquid communication portion of said capillary force generating member container;

wherein said capillary force generating member includes at least two liquid storage members made of fibers and contacted with each other, the at least two liquid storage members being contained entirely within said capillary force generating member container; and wherein an upper end of the liquid communication portion is located above a contact surface between the at least two liquid storage members.

2. The liquid supply system according to claim 1 wherein the contact surface is present below a lower end of the liquid communication portion.

3. The liquid supply system according to claim 1 wherein a dynamic resistance of liquid in the liquid storage member above the contact surface is smaller than that of liquid in the liquid storage member below the contact surface.

4. The liquid supply system according to claim 1 wherein a capillary force of the liquid storage member above the contact surface is smaller than that of the liquid storage member below the contact surface.

5. The liquid supply system according to claim 1 wherein a fiber density of the liquid storage member above the contact surface is lower than that of the liquid storage member below the contact surface.

6. The liquid supply system according to claim 1 wherein a main fiber direction of a liquid storage member constituting the capillary force generating member is almost horizontal while the liquid storage member is operated.

7. The liquid supply system according to claim 6 wherein a layer of the liquid storage member having the main fiber direction in an almost horizontal direction is present near to the upper end of the liquid communication portion.

8. The liquid supply system according to claim 1 wherein the liquid storage members have different capillary forces and the liquid storage member having a capillary force higher than that of the other liquid storage member is brought into contact with the liquid supply portion.

9. The liquid supply system according to claim 8 wherein a main fiber direction of the liquid storage member in contact with the liquid supply portion is parallel with a liquid supply direction.

10. The liquid supply system according to claim 1 wherein the liquid communication portion is set above the liquid supply portion.

11. A capillary force generating member container, comprising:

a capillary force generating member for holding liquid;

a liquid communication portion to which the liquid is supplied from a removable liquid containing vessel;

an atmospheric air communication portion for communicating with atmospheric air; and a liquid supply portion for supplying liquid to an outside thereof, wherein said capillary force generation member is provided with at least two liquid storage members made of fibers and contacted with each other, the at least two liquid storage members being contained entirely within said capillary force generating member container, wherein a contact surface between the at least two liquid storage members is present below an upper end of the liquid communication portion; and wherein the removable liquid containing vessel defines a substantially closed space except for a connection portion when the removable liquid containing vessel is connected to said capillary force generating member container at said liquid communication portion, the connection portion being connectable to said liquid communication portion.

* * * * *

UNITED STATES PATENT AND TRADEMARK OFFICE

CERTIFICATE OF CORRECTION

PATENT NO. : 6,382,783 B1
DATED : May 7, 2002
INVENTOR(S) : Hiroki Hayashi et al.

It is certified that error appears in the above-identified patent and that said Letters Patent is hereby corrected as shown below:

Title page,
Item [57], ABSTRACT,
Line 10, “member” should read -- member, --.

Column 6,
Line 54, “is flows” should read -- flows --.

Column 7,
Line 44, “fixed” should read -- fixed to --;
Line 47, “the like, or” should be deleted; and
Line 66, “each” should read -- with each --.

Column 9,
Line 20, “other” should read -- another --; and
Line 55, “unit” should read -- unite --.

Column 11,
Line 63, “same” should read -- which is the same --.

Column 19,
Line 65, “area” should read -- area. --.

Column 24,
Line 45, “the” should be deleted.

Column 26,
Line 36, “other” should read -- another --;
Line 40, “a component” should read -- components the --; and
Line 41, “is” (first occurrence) should read -- are --, and “symbol and its” should read -- symbols and their --.

UNITED STATES PATENT AND TRADEMARK OFFICE

CERTIFICATE OF CORRECTION

PATENT NO. : 6,382,783 B1
DATED : May 7, 2002
INVENTOR(S) : Hiroki Hayashi et al.

It is certified that error appears in the above-identified patent and that said Letters Patent is hereby corrected as shown below:

Column 27,
Line 11, “removably” should read -- removable --; and
Line 63, “embodiment is” should read -- embodiments are --.

Signed and Sealed this

Twenty-first Day of January, 2003

JAMES E. ROGAN
*Director of the United States Patent and Trademark Office*